US005460359A

United States Patent [19]

Toyohara et al.

[11] Patent Number: 5,460,359

[45] Date of Patent: Oct. 24, 1995

[54] BINDING APPARATUS FOR BINDING SHEETS OF CUT PAPER PRINTED BY A PRINTING MACHINE

[75] Inventors: Mie Toyohara; Masaru Iida; Takeshi Sugimoto, all of Kawasaki, Japan

[73] Assignee: Fujitsu Limited, Kanagawa, Japan

[21] Appl. No.: 88,085

[22] Filed: Jul. 6, 1993

[30] Foreign Application Priority Data

Jul. 6, 1992 [JP] Japan ..... 4-178170

[51] Int. Cl.[6] ..... B42C 1/12; B65H 31/30; B65B 13/07

[52] U.S. Cl. ..... 270/1.1; 270/53; 414/790.2; 100/4; 100/7

[58] Field of Search ..... 270/53, 58; 414/790.2, 414/924, 927, 794.4, 794.8; 100/16, 17, 18, 20, 4, 7, 10; 53/582, 587, 588

[56] References Cited

U.S. PATENT DOCUMENTS

| | | | |
|---|---|---|---|
| 2,982,063 | 5/1961 | Coleman et al. | 100/17 X |
| 3,759,402 | 9/1973 | Hitch et al. | 414/790.3 |
| 3,995,748 | 12/1976 | Looney | 270/53 X |
| 4,090,441 | 5/1978 | Muller | 100/7 |
| 4,295,733 | 10/1981 | Janssen et al. | 270/58 X |
| 4,368,972 | 1/1983 | Naramore | 335/324 X |
| 4,424,660 | 1/1984 | Sato et al. | 53/588 X |
| 4,444,491 | 4/1984 | Rinehart et al. | 270/53 X |
| 4,566,244 | 1/1986 | Kawano et al. | 53/588 |
| 4,582,421 | 4/1986 | Hamlin et al. | 355/324 X |
| 4,727,803 | 3/1988 | Nobuta et al. | 100/18 X |
| 4,785,731 | 11/1988 | Nguyen | 100/4 |
| 4,891,681 | 1/1990 | Fiske et al. | 270/53 X |
| 4,991,374 | 2/1991 | Bademacher et al. | 53/582 X |

FOREIGN PATENT DOCUMENTS

| | | | |
|---|---|---|---|
| 62-93170 | 4/1987 | Japan | 414/790.2 |
| 1-124515 | 5/1989 | Japan | 53/582 |
| 2220893 | 9/1990 | Japan . | |
| 4144792 | 5/1992 | Japan . | |
| 4253615 | 9/1992 | Japan . | |
| 4253469 | 9/1992 | Japan . | |

*Primary Examiner*—John E. Ryznic

[57] ABSTRACT

In a printing system in which printing is conducted on sheets of cut paper supplied from a sheet hopper and the printed sheets are stacked in a stack unit, the binding apparatus binds a bundle of sheets of printed cut paper discharged to the stack unit, wherein the binding apparatus includes: a conveyance arm that holds an end portion of the bundle of printed cut paper in a vertical direction and conveys them in a horizontal direction; a binding machine that binds the bundle of sheets of cut paper conveyed by the conveyance arm with a band-shaped or string-shaped binding medium; an output unit that stocks and outputs the bundle of sheets that have been bound; and a control unit that controls the conveyance arm, binding machine and output unit. The conveyance arm includes a hand unit to hold the bundle of sheets of cut paper, a traveling unit provided adjacent to the hand unit, and a traveling guide unit provided with a rail on which the traveling unit travels, wherein the hand unit holds the bundle of printed cut paper in a vertical direction and moves them in a horizontal direction.

32 Claims, 24 Drawing Sheets

BINDING APPARATUS FOR BINDING SHEETS OF CUT PAPER PRINTED BY A PRINTING MACHINE

BACKGROUND OF THE INVENTION

1. Field of the Invention

The present invention relates to a binding apparatus, and more particularly relates to a binding apparatus capable of binding sheets of cut paper printed and outputted by a printing machine so that the sheets of cut paper can be bound and sorted by a number predetermined for each job.

2. Description of the Related Art

With the recent progress in information processors, it is necessary to sort a large number of sheets of paper printed and outputted by a printing machine. For example, in the case of a high speed printing machine for printing sheets of cut paper in a computer center, it is necessary to sort the sheets of outputted cut paper for each job as an after-treatment. Therefore, it is desired to reduce labor and automate the after-treatment after the sheets of cut paper have been outputted from the printing machine.

In the case of a conventional printing machine for printing sheets of cut paper, sheets of printed cut paper are sorted for each job, that is, the after-treatment is conducted for each job-offset. With reference to FIG. 1, this after-treatment for each job-offset will be explained as follows.

An example of the structure of a conventional printing system PS is shown in FIG. 1. The conventional printing system PS includes a sheet hopper H to feed sheets of cut paper S one by one, a printing machine P to print on the sheets of cut paper S, and a sheet after-treatment unit A to conduct an after-treatment on the sheets of printed cut paper S.

The printing machine P includes a photoreceptor drum 1, development unit 2, fixing unit 3, cleaner 4, charging unit 5, optical unit 6, transfer separator 7, and conveyance unit 8. The optical unit 6 includes a mirror motor 61, polygonal mirror 62, beam emitting mirror 63, reflection mirror 64, and laser diode 65.

The photoreceptor drum 1 is electrically charged by the charging unit 5, and a latent image is formed on the photoreceptor drum 1 by a laser beam sent from the optical unit 6. This latent image is developed by the development unit 2, so that a toner image is formed. Then, the sheets of cut paper S are successively fed one by one to the printing machine P from the sheet hopper H by the roller R. The sheet of cut paper S sent from the sheet hopper H is conveyed by the conveyance roller Ri provided on the printing machine P side, and arrives on the photoreceptor drum 1. At this time, the toner image on the photoreceptor drum 1 is transferred onto this sheet of cut paper S by the transfer separator 7. In this connection, in order to stabilize the formation of the latent image, a portion of the laser beam is taken out by the beam emitting mirror 63 so as to check the intensity of the laser beam.

This sheet of cut paper S is further conveyed by the conveyance unit 8, and the toner image on the sheet is fixed by a heat roller having a heater in the fixing unit 3. After that, the sheet of cut paper S is conveyed by the conveyance roller $R_0$ onto a stack table 9 in the sheet after-treatment unit A so as to be stacked. At this time, in the conventional printing system PS, the stack table 9 is laterally shifted for each job (job-offset).

Due to the foregoing operation, the sheets of printed cut paper S are stacked on the stack table 9 in such a manner that several tens or several hundreds of sheets are formed into a bundle and stacked in an uneven manner as shown in FIG. 1.

However, the following problems may be encountered in the conventional printing system PS constructed in the aforementioned manner. That is, in the case of the conventional printing system PS, the printed sheets are sorted by job-offset, however, the following problems are caused.

As shown in FIG. 1, the printed sheets S are only stacked on the stack table 9 forming an off-set for each job. Accordingly, when these sheets of cut paper S are handled, there is a possibility that the bundles of sheets S collapse and disperse. When an operator takes the printed and outputted sheets S, the operation of the printing system PS must be stopped for safety. Therefore, the printing speed is substantially decreased.

In order to solve the aforementioned problems caused in the process of job-offset, the printed sheets are stapled by a stapler as an after-treatment. However, the following problems are encountered in the after-processing conducted by the stapler.

(1) Since the length of staples is limited, the number of sheets to be stapled is limited to a small number.

(2) When stapled sheets S are stacked, the thickness of the stapled portion is increased, so that the bundle of sheets S is inclined, which is disadvantageous in handling.

As described above, the conventional after-treatment mechanisms such as a stacking mechanism to use job-offset and a stapling mechanism to use a stapler are not suitable for a cut sheet printing system to print a large number of sheets at high speed to be used in computer centers.

SUMMARY OF THE INVENTION

It is an object of the present invention to provide a binding apparatus capable of effectively binding a predetermined number of sheets of printed cut paper outputted at high speed from a printing machine in a printing system.

According to one embodiment of the present invention, sheets of cut paper that have been printed by a printing machine are stacked on a stack table for each job-offset. The stacked sheets are moved by a conveyance arm to a tying machine and bound for each job-offset. Then, the bound sheets are stacked and held in an output unit. Accordingly, the printed cut sheets are not dispersed while they are being handled. Also, even when an operator takes a bundle of outputted cut sheets, it is not necessary to stop the operation of the printing machine because the operator takes the bundle of outputted cut sheets from a stock unit located separately from the stack table of the printing machine. Unlike a case in which a stapling operation is conducted by a stapler, even when a large number of cut sheets are subjected to job-offset, they can be bound.

According to the binding apparatus of the present invention, when a binding apparatus such as a band tying mechanism is added to a high speed cut sheet printing machine, the cut sheets are bound with a binding medium, so that the cut sheets are not dispersed.

Further, even when the operator takes the printed and outputted cut sheets, they cannot be taken out from the stack table adjacent to the printing machine but from the output table separate from the printing machine. Therefore, it is not necessary to stop the operation of the printing machine, so that a high speed printing operation can be carried out without substantially reducing the printing speed. Unlike a case in which the printed cut sheets are stapled by a stapler, the number of cut sheets to be bound is not limited in the case of the present invention. Accordingly, even when a large number of cut sheets are outputted as job-output, they can be positively bound.

In the case of the present invention, the number of bands to be used as a binding medium can be arbitrarily designated according to the necessity and workability of the operator. When the number of bands is not designated, a plurality of bands are automatically applied in accordance with the number of sheets of cut paper, so that the workability can be improved.

Further, a sheet width guide, which is an auxiliary plate, is provided on the side of the binding apparatus. Therefore, even when the number of sheets to be bound is small, the bundle of sheets is not bent, and it can be bound with an appropriate force. Further, when the width of this sheet width guide is allowed to be variable, sheets of different size can be processed with this guide, and this guide can be withdrawn in the process of sheet conveyance so that the sheets cannot be blocked.

In this connection, it is also possible to automatically drive the output table. Accordingly, it is convenient to stack and take the cut sheet bundles. Further, when an interface is attached to the binding apparatus of the present invention so that the bundles of sheets can be automatically transferred to another conveyance means, the cut sheet bundles can be automatically conveyed to another conveyance means.

BRIEF DESCRIPTION OF THE DRAWINGS

The present invention will be more clearly understood from the following detailed description in connection with the attached drawings, in which:

FIG. 21A is a plan view of the binding apparatus of the fourth example shown in FIG. 19A in which the sheet width guide is provided, wherein FIG. 21A shows a condition in which the sheet width guide is set wide;

FIG. 21B is a plan view of the binding apparatus of the fourth example shown in FIG. 19A in which the sheet width guide is provided, wherein FIG. 21B shows a condition in which the sheet width guide is set narrow;

DESCRIPTION OF THE PREFERRED EMBODIMENT

With reference to the attached drawings, the most preferred embodiment of the present invention will be explained in detail as follows.

Figure 2:
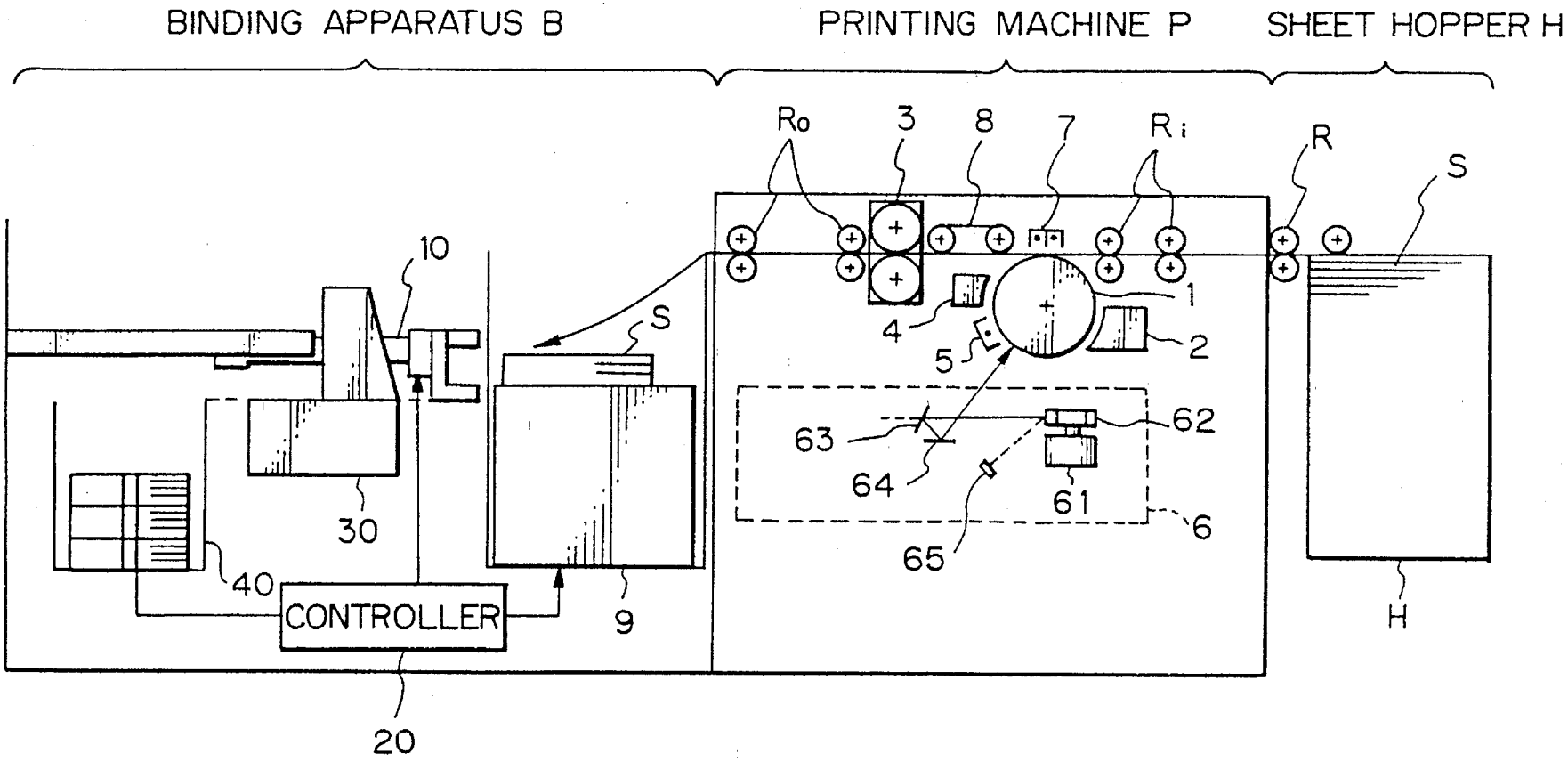
FIG. 2 is an overall arrangement view of a printing system provided with a binding apparatus of an example of the present invention.

FIG. 2 shows an overall arrangement of an example of the present invention. FIG. 2 schematically shows the structure of the binding apparatus B of the present invention that is attached to the printing machine P and the sheet hopper H.

Figure 1:
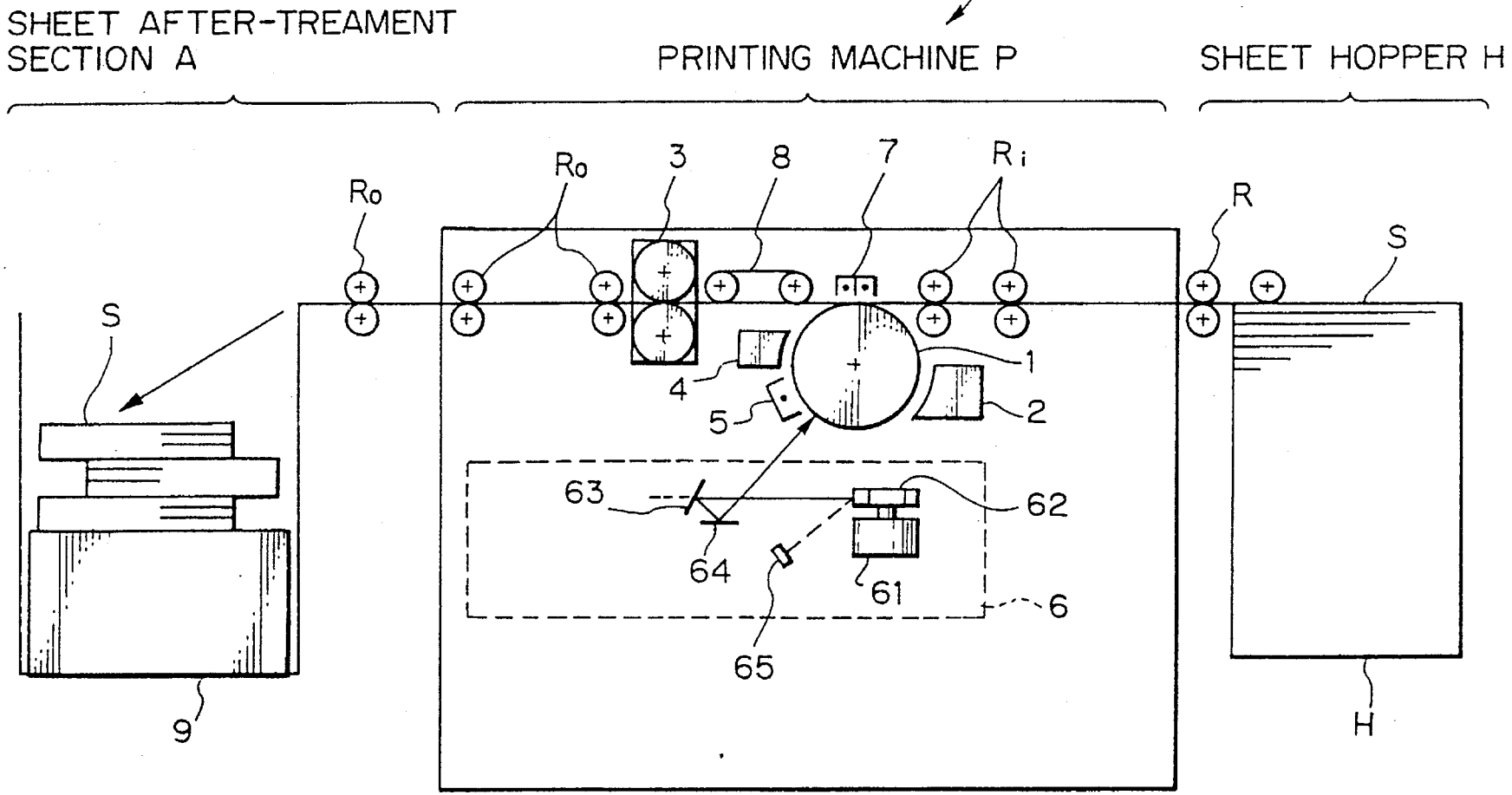
Fig. 1 PRIOR ART
FIG. 1 is an overall arrangement view of a conventional printing system.

In this example, the sheet hopper H and the printing machine P are the same as those of the conventional example shown in FIG. 1, and they are of the prior art.

The sheet hopper H feeds sheets of cut paper S one by one to the printing machine P. The printing machine P includes a photoreceptor drum 1, development unit 2, fixing unit 3, cleaner 4, charging unit 5, optical unit 6, transfer separator 7, and conveyance unit 8. The optical unit 6 includes a mirror motor 61, polygonal mirror 62, beam emitting mirror 63, reflection mirror 64, and laser diode 65.

The photoreceptor drum 1 is electrically charged by the charging unit 5, and a latent image is formed on the photoreceptor drum 1 by a laser beam sent from the optical unit 6. This latent image is developed by the development unit 2, so that a toner image is formed. Then, the sheets of cut paper S are successively fed one by one to the printing machine P from the sheet hopper H by the roller R. The sheet of cut paper S sent from the sheet hopper H is conveyed by the conveyance roller Ri provided on the printing machine P side, and arrives on the photoreceptor drum 1. At this time, the toner image on the photoreceptor drum 1 is transferred onto this sheet of cut paper S by the transfer separator 7. In this connection, in order to stabilize the formation of the latent image, a portion of the laser beam is taken out by the beam emitting mirror 63 so as to check the intensity of the laser beam.

This sheet of cut paper S is further conveyed by the conveyance unit 8, and the toner image on the sheet is fixed by a heat roller having a heater in the fixing unit 3. Then, the sheet of cut paper S is outputted to the binding apparatus B of the present invention by the conveyance roller $R_O$.

The binding apparatus B of the present invention includes: a stack table 9 on which printed cut sheets are stacked; a conveyance arm 10 that holds and conveys a predetermined number of cut sheets stacked on the stack table 9; a binding machine 30 provided in the middle of a passage in which the conveyance arm 10 conveys the cut sheets; an output unit 40 that stocks and outputs the tied cut sheets; and a controller 20 that controls these units.

Figure 3:
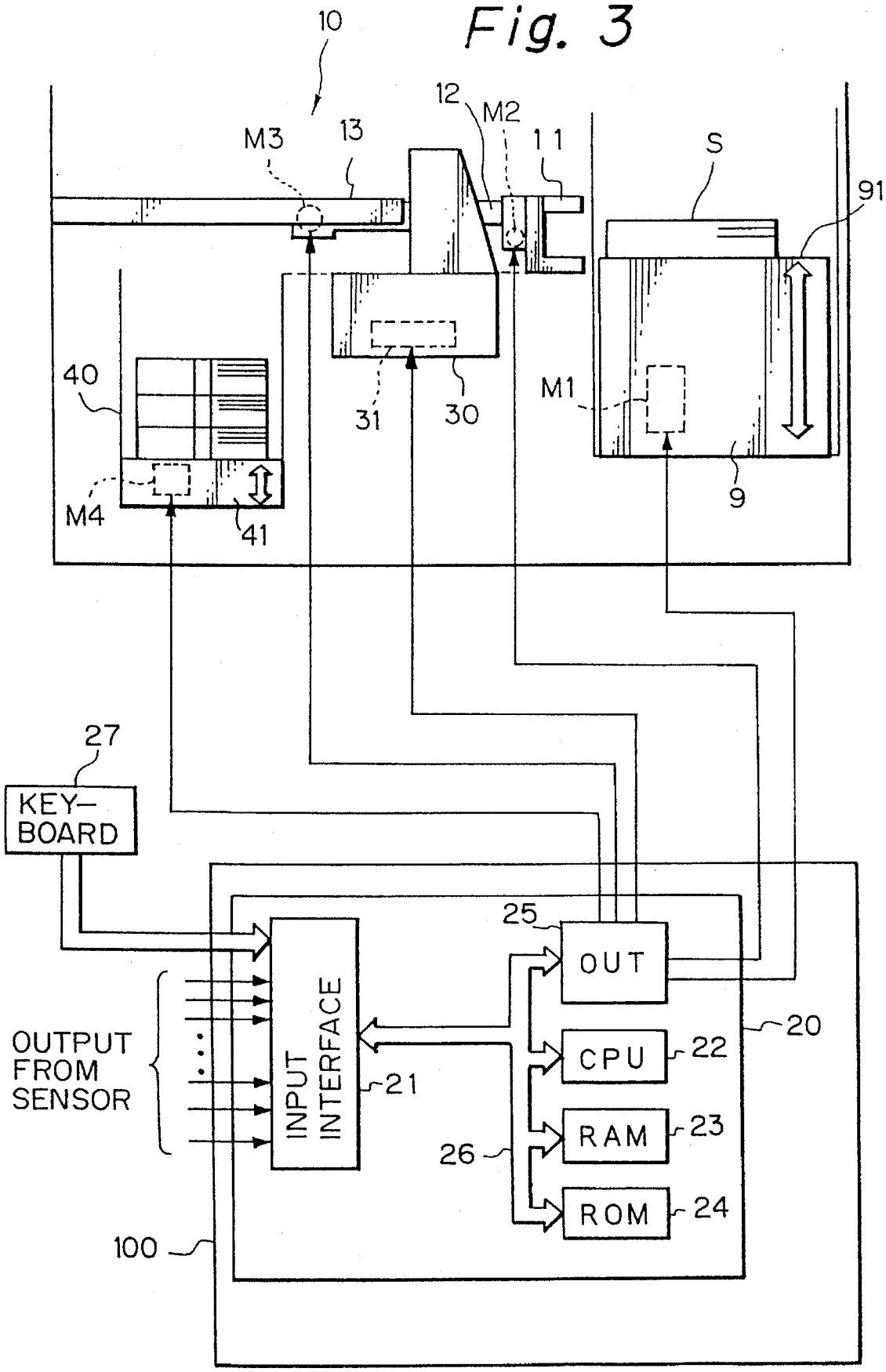
FIG. 3 is an arrangement view showing the structure of drive motors and their control circuits in the binding apparatus shown in FIG. 2.

FIG. 3 is an arrangement view to explain in further detail the structure of an example of the binding apparatus B of the present invention shown in FIG. 2. The stack table 9 is provided with a table 91 elevated in accordance with the number of cut sheets outputted from the printing machine P, and also provided with an up/down motor M1 to elevate this table 91. The conveyance arm 10 includes: a hand portion 11 to hold the cut sheets S outputted onto the stack table 9; a traveling unit 12 connected with this hand portion 11; and a traveling guide unit 13 provided for this traveling unit 12. The hand portion 11 is provided with a motor M2 too move an arm described later, and the traveling unit 12 is provided with a motor M3 to drive traveling wheels described later. The tying machine 30 is provided with a tying processing portion 31 for tying the cut sheets S. The output unit 40 is provided with a table 41 on which a bundle of tied cut sheets S are stacked, and an up/down motor M4 to elevate this table.

Motors M1 to M4 provided in the binding apparatus B, and the tying processing portion 31 are controlled by the controller 20 provided in a printing machine mechanism control unit 100 of the printing machine P shown in FIG. 2.

The controller 20 includes an input interface 21, central processing unit (CPU) 22, random access memory (RAM) 23, read-only memory (ROM) 24, output circuit (OUT) 25, and bus line 26 through which the above units are connected. Signals to be sent to the motors M1 to M4 provided in the binding apparatus B and also to be sent to the tying processing portion 31 are outputted from the output circuit 25. To the input interface 21, pieces of information are inputted such as an output signal sent from a sensor (not shown) to detect the positions of the elevation table 41 of the output unit 40 and the elevation table 91 of the stack table 9, an output signal sent from a sensor (not shown) to detect the position of the arm of the hand portion 11, and an output signal sent from a sensor to detect the position of the traveling unit 12. Also, pieces of information are inputted such as control information of the number of sheets of cut paper to be tied, wherein the control information is inputted from the key board 27.

With reference to FIGS. 4 to 13, specific examples of the arrangements of the stack table 9, conveyance arm 10, tying machine 30 and output portion 40 shown in FIG. 3 will be explained as follows.

Figure 4:
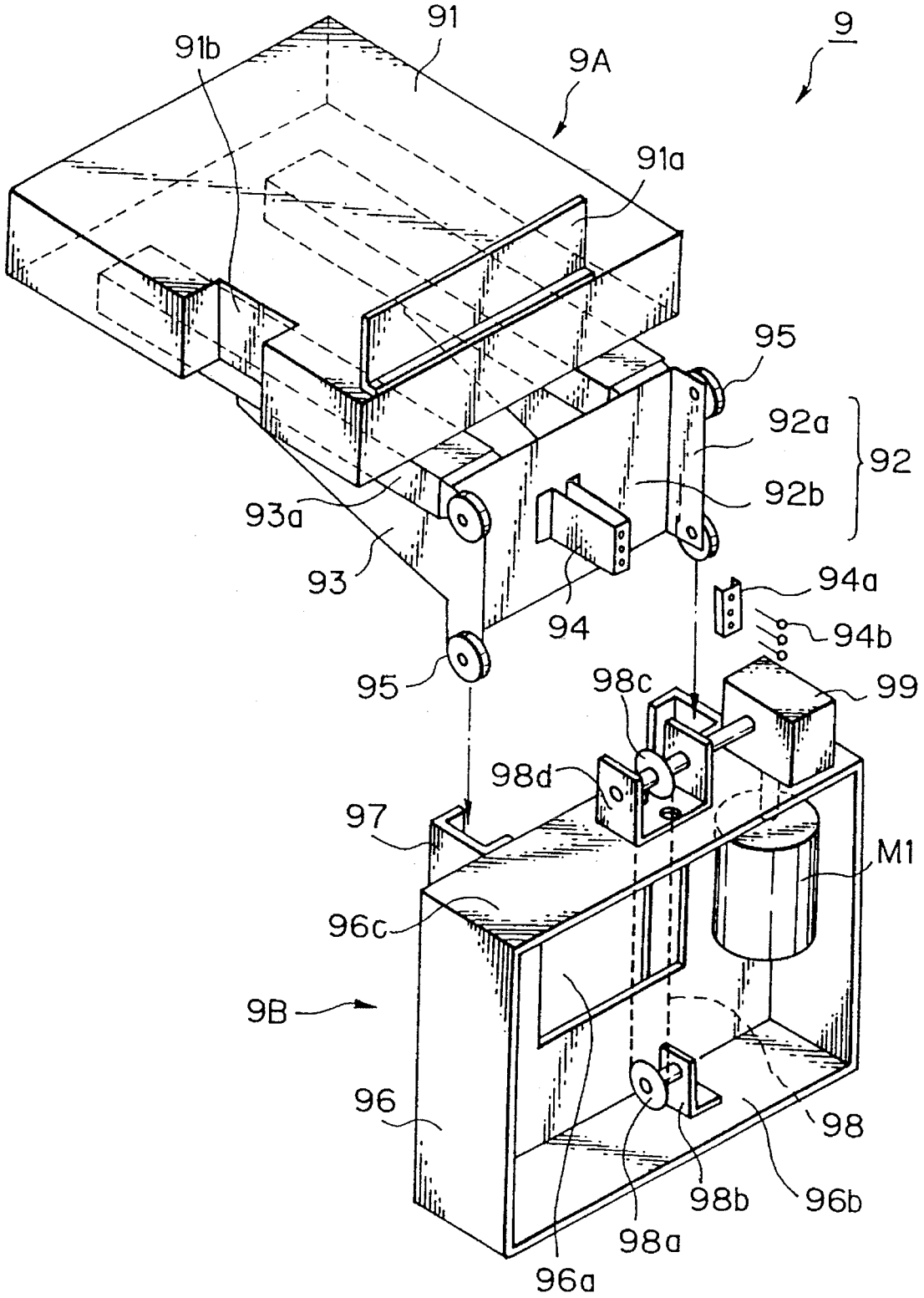
FIG. 4 is a perspective assembly view showing the structure of the stack table shown in FIG. 2.
Figure 5:
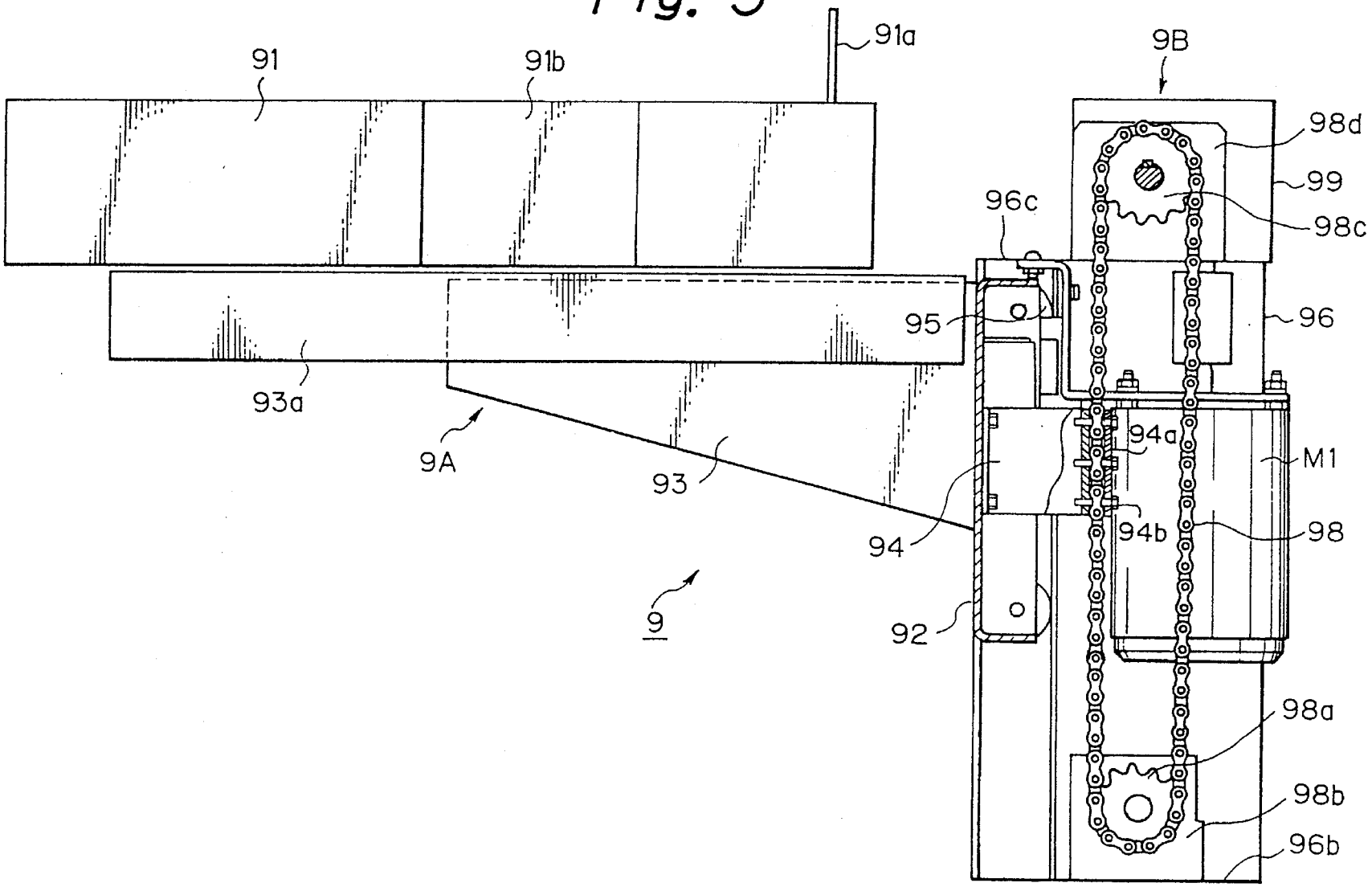
FIG. 5 is a partially sectional side view showing the structure of, the assembled stack table shown in FIG. 4.

FIGS. 4 and 5 show an arrangement of the stack table 9. The stack table 9 is provided with an elevation unit 9A and base unit 9B, wherein the elevation unit 9A is elevated with respect to the base unit 9B.

The elevation unit 9A includes an elevation frame 92, and two arms 93 are protruded from a back plate 92*b* of the elevation frame 92. Re elevation table 91 is mounted on the two arms 93 through auxiliary arms 93*a*. On an upper surface of the elevation table 91, there is provided an adjustable guide plate 91*a* to align the end portions of sheets of cut paper stacked on this upper surface. A cutout portion 91*b* into which the conveyance arm is inserted is formed in an edge portion of the elevation table 91, the edge portion being adjacent to the conveyance arm 10. Further, on a side plate 92*a* of the elevation frame 92, there are provided 4 wheels 95, wherein the two wheels are provided on one side, and the other two wheels are provided on the other side. Further, on the back plate 92*b* of the elevation frame 92, there is provided a bracket 94 to fix a chain 98 attached onto the base portion 9B side.

In the base unit 9B, on the front surface side of the casing 96, U-shaped rails 97 are provided in such a manner that the open sides of the U-shaped rails are opposed to each other. An opening 96*a* is formed in the casing 96 between the two rails 97. The elevation unit 9A is attached to the base unit 9B under the condition that the wheels 95 are inserted into the rails 97. Brackets 98*b* and 98*d* are respectively provided on a bottom plate 96*b* and a ceiling board 96*c* of the base unit 9B. Rotatable sprockets 98*a* and 98*c* are respectively attached to these brackets 98*b* and 98*d*, and a chain 98 is provided between these two sprockets 98*a* and 98*c*.

In the casing 96, there is provided a motor M1 which is upwardly attached to the casing 96 through a bracket. The rotational shaft of the motor M1 rotates the sprocket 98*c* mounted on the ceiling board 96*c* of the casing 96, through a reduction gear mechanism 99 having a worm gear mechanism.

As shown in FIG. 5, the chain 98 is fixed to the bracket 94 protruded from the back plate 92*b* of the elevation unit 9A in such a manner that the chain 98 is interposed between the bracket 94 and a chain fixing plate 94*a*, and a bolt 94*b* is inserted into the bracket 94 and the chain fixing plate 94*a*.

In the stack table 9 constructed as described above, when the motor M1 is driven, the chain 98 is rotated, and the elevation unit 9A fixed to the chain 98 is elevated with respect to the base unit 9B. A sensor (not shown) is provided between the elevation unit 9A and the base unit 9B. As explained in FIG. 3, the controller 20 controls the rotation of the motor M1 by the detection output of the sensor in accordance with the position of the elevation unit 9A with respect to the base unit 9B.

FIGS. 6 to 9 show an arrangement of the conveyance arm 10. As described before, the conveyance arm includes the hand portion 11, traveling unit 12 and traveling guide unit 13, which will be respectively explained as follows.

The hand portion 11 includes a back plate 101, a ceiling plate 102 protruded from the back plate 101, and a bottom plate 103, wherein the bottom plate 103 is formed longer than the ceiling plate 102. Between the ceiling plate 102 and the bottom plate 103, there are provided two cylindrical guide shafts 105 disposed in parallel with the back plate 101, and there is also provided a screw shaft 104 disposed between the two guide shafts 105. An elevation plate 106 is provided in parallel with the bottom plate 103 being guided by the two guide shafts 105 and screwed with the screw shaft 104. A presser plate 108 is provided at the fore end of the elevation plate 106 through an attaching shaft 107.

A worm gear mechanism 114 is provided on the ceiling plate 102 side of the screw shaft 104. A rotational shaft 113 is attached by the back plate 101 and a bracket 112 in parallel with the ceiling plate 102, and when the rotational shaft 113 is rotated, the screw shaft 104 is rotated by the action of the worm gear mechanism 114. The rotational shaft 113 is extended to the outside of the back plate 101, and a pulley 110 is provided in the extended portion of the rotational shaft 113.

Figure 7:
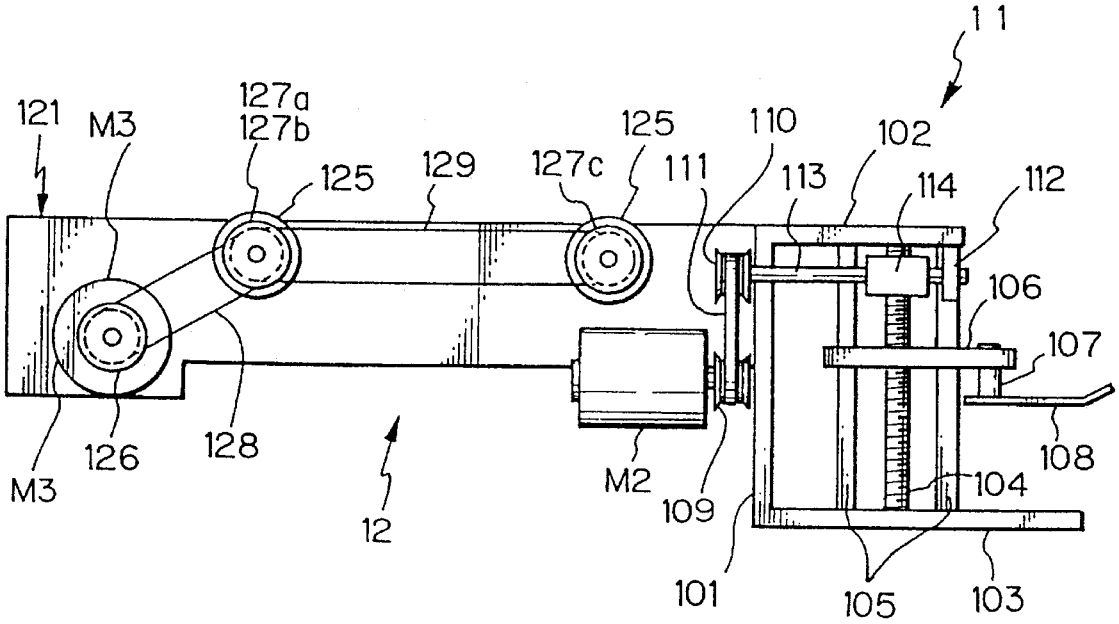
FIG. 7 is a schematic illustration showing the structure of the conveyance arm drive mechanism in FIG. 6.

On the other hand, as shown in FIG. 7, a motor M2 is provided on the traveling unit 12 side of the back plate 101, and a belt 111 is provided between a drive pulley 109 attached to the drive shaft of the motor M2 and the aforementioned pulley 110.

Accordingly, when the motor M2 is driven, the rotation is transmitted to the rotational shaft 113 through the drive pulley 109, belt 111, and pulley 110. By the rotation of the rotational shaft 113, the screw shaft 104 is rotated through the worm gear mechanism 114, so that a distance between the presser plate 108 and the bottom plate 103 can be changed. The distance between the presser plate 108 and the bottom plate 103 can be adjusted in the following manner: a height of the presser plate 108 or the elevation plate 106 is detected by a position sensor not shown; and as explained in FIG. 3, the rotation of the motor M2 is controlled by the controller 20 in accordance with the detection output of the position sensor. Also, a pressure sensor may be provided on the presser plate 108 so that the pressure of the presser plate 108 can be detected when sheets of cut paper are held by the presser plate 108, and the rotation of the motor M2 may be controlled in accordance with the result of the detection.

The traveling unit 12 is provided with a slender frame portion 121 connected with the back plate 101 of the hand portion 11. This frame portion 121 is provided with lateral direction guide wheels 123, longitudinal direction guide wheels 124, and traveling wheels 125. The lateral direction guide wheels 123 are attached to both end portions of a bracket 122 protruded from a side plate 121*a* of the frame 121. Four brackets 122 are attached onto the side plates 121*a* of the frame 121. The longitudinal guide wheels 124 are respectively provided by the side of the 8 lateral direction guide wheels 123 attached onto the side plates 121*a*. These lateral direction guide wheels 123 and the longitudinal direction guide wheels 124 are free wheels, and movably hold the frame 121 in the traveling guide 13. They do not move the frame 121.

Figure 8:
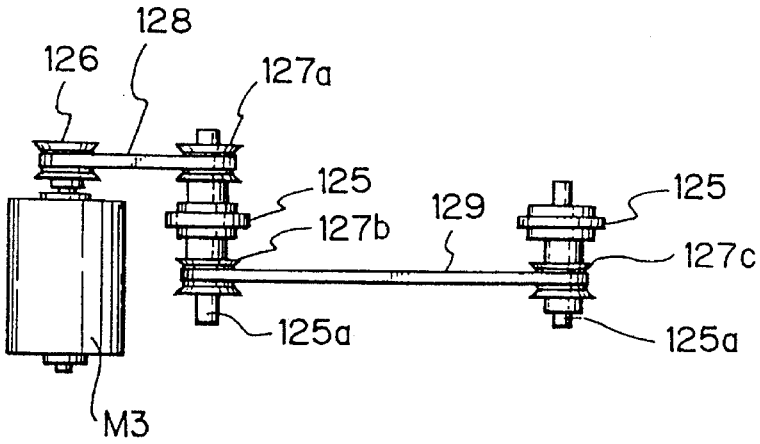
FIG. 8 is a partial plan view showing the drive mechanism of the traveling wheel of the conveyance arm in FIG. 7.

As shown in FIGS. 7 and 8, the traveling wheels 125, a portion of which is exposed from an opening 121*c* formed on a ceiling plate 121*b* of the frame 121, are driven by the motor M3. That is, a drive pulley 126 attached to a rotational shaft of the motor M3, and a pulley 127 attached to a rotational shaft 125*a* of one of the traveling wheels 125, are connected by a belt 128. Further, the two traveling wheels 125 are rotated being linked with each other by a belt 129 provided between pulleys 127*b* and 127*c* attached to the rotational shafts 125*a* of the traveling wheels 125.

Figure 6:
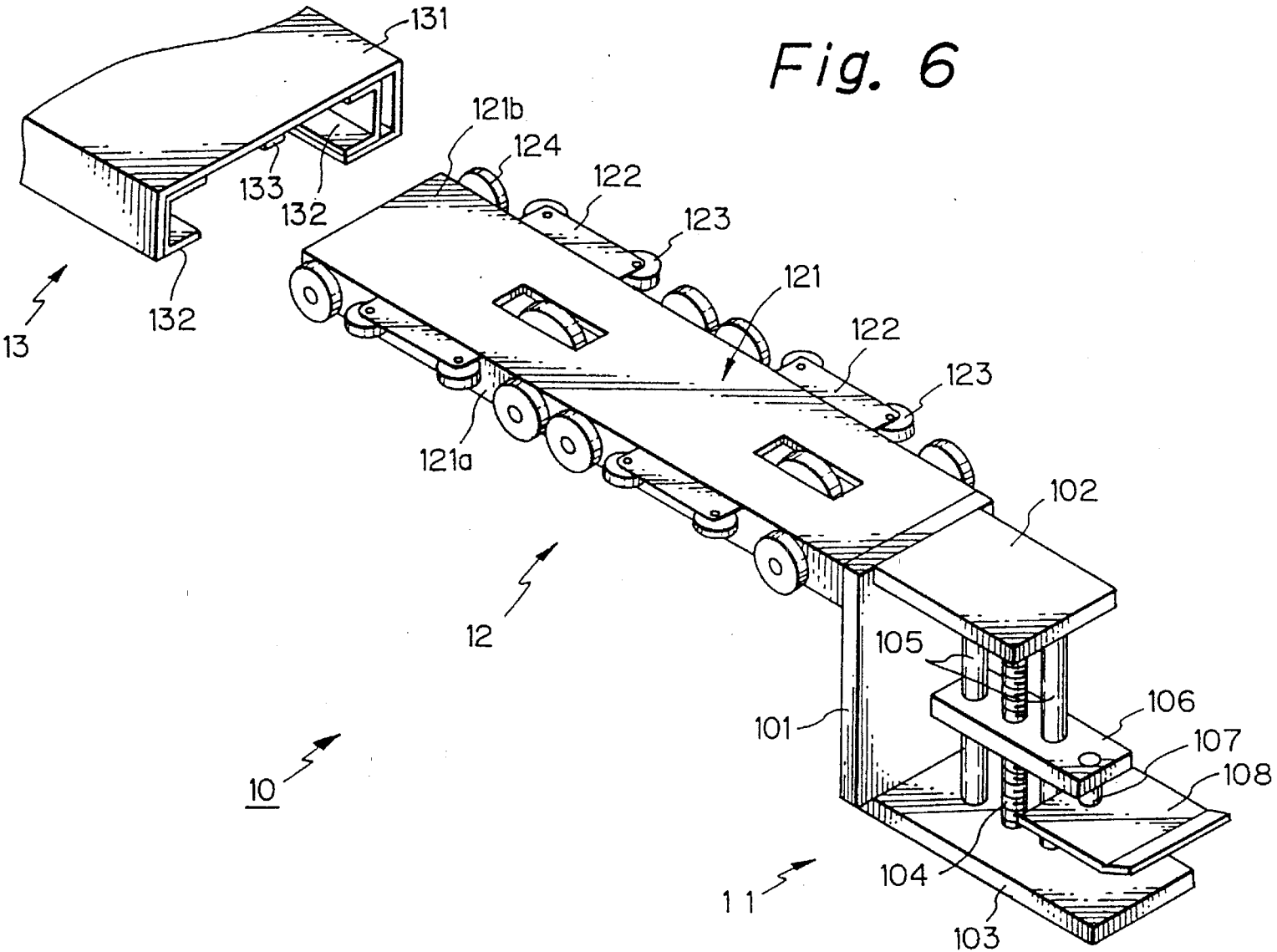
FIG. 6 is a perspective assembly view showing the conveyance arm in FIG. 2.

As shown in FIG. 6, the traveling guide unit 13 includes a guide frame 131, and two guide rails 132 and one traveling rail 133 which are provided on the lower surface of the guide frame 131. The two guide rails 132 are respectively formed into a U-shape and the opening portions of the two guide rails are opposed to each other. The lateral direction guide wheels 123 and the longitudinal direction guide wheels 124 of the traveling unit 12 are inserted into the guide rails 132. The traveling rail 133 is provided in the center on the lower surface of the guide frame 131, and the traveling wheels 125 of the traveling unit 12 come into contact with this traveling rail 133.

Accordingly, when the traveling wheels 125 are rotated by the rotation of the motor M3, the traveling unit 12 travels inside the guide frame 131 under the condition that the traveling unit 12 is regulated by the lateral direction guide wheels 123 and the longitudinal direction guide wheels 124. The position of the traveling unit 12 can be adjusted when the rotation of the motor M3 is controlled by the detection output of a position sensor provided between the traveling frame 121 and the traveling guide unit 13.

Figure 9:
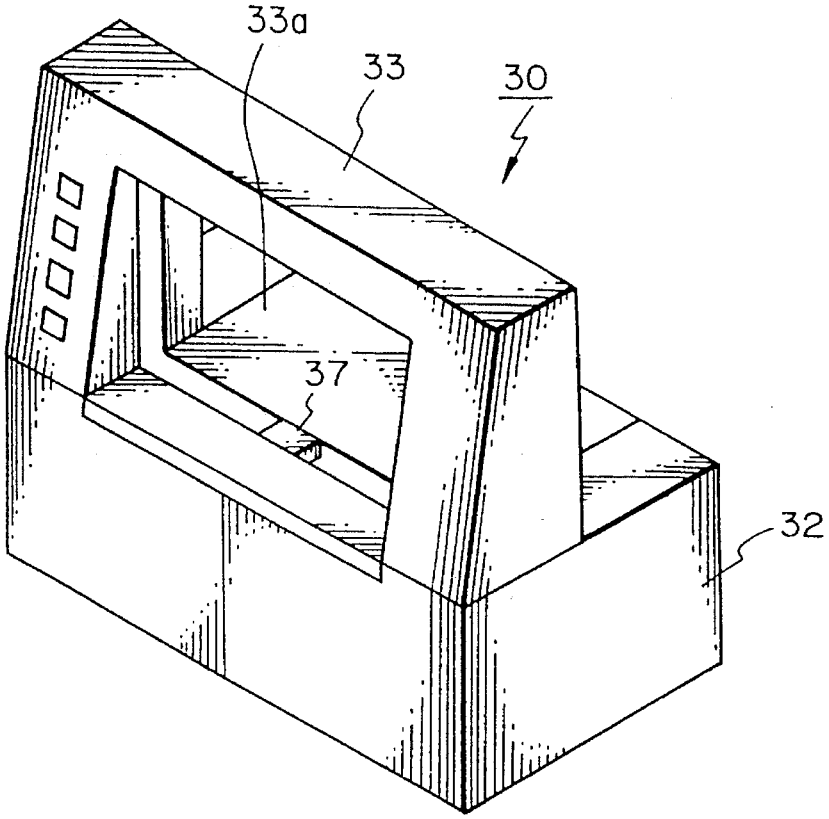
FIG. 9 is a perspective view showing the appearance of the tying machine in FIG. 2.
Figure 10:
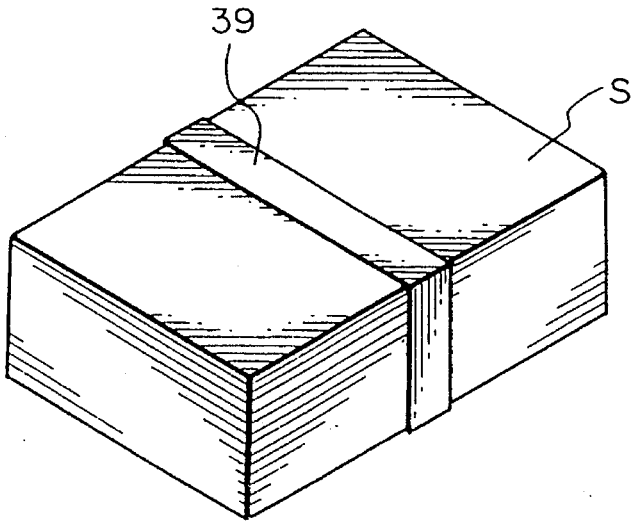
FIG. 10 is a perspective view showing a bundle of cut sheets that are tied by the tying machine in FIG. 9.

FIG. 9 is a view showing an outer appearance of the tying machine 30. A U-shaped band guide 33 is provided in the upper portion of a main body case 32 of the tying machine 30, and documents placed in a space 33*a* encircled by the band guide 33 are tied with a band. FIG. 10 is a view showing an outer appearance of sheets of cut paper S which are tied with the band 39 by the tying machine 30.

Figure 11A:
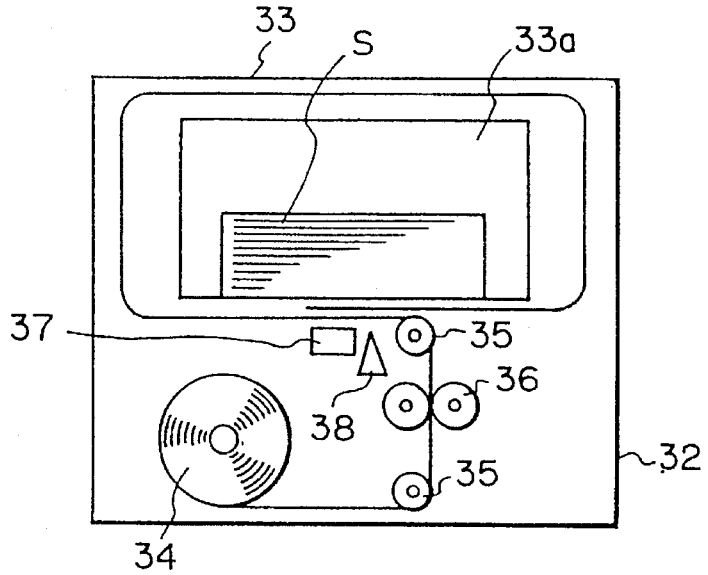
FIGS. 11A to 11C are schematic illustrations for explaining the operation in which cut sheets are tied with the tying machine shown in FIG. 9.

As shown in FIG. 11A, inside the main body case 32 of the tying machine 30, there are provided a roll-shaped band 34, roller 35, supply roller to supply the band 34, heater 37 to fuse the overlapped band 34 and cutter 38 to cut the band 34.

A band is supplied from the roll-shaped band 34 by the supply roller 36, and previously encircles the band guide 33, and an end of the band is located close to the heater 37. When sheets of cut paper S are inserted into a space 33*a*, the supply roller 36 is reversed and at the same time the roll-shaped band 34 is also reversed so that the band can be wound. Therefore, the band 34 in the band guide 34 is pulled. At this time, the fore end of the band is fixed by a mechanism not shown in the drawings.

Figure 11B:
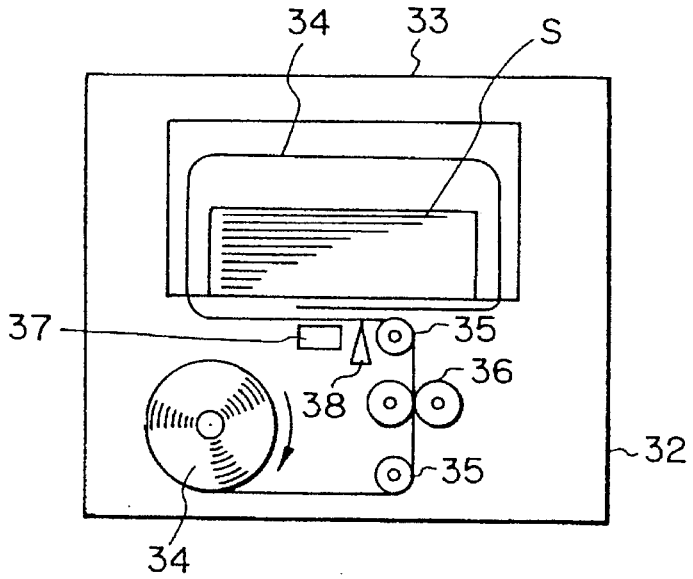
Figure 11C:
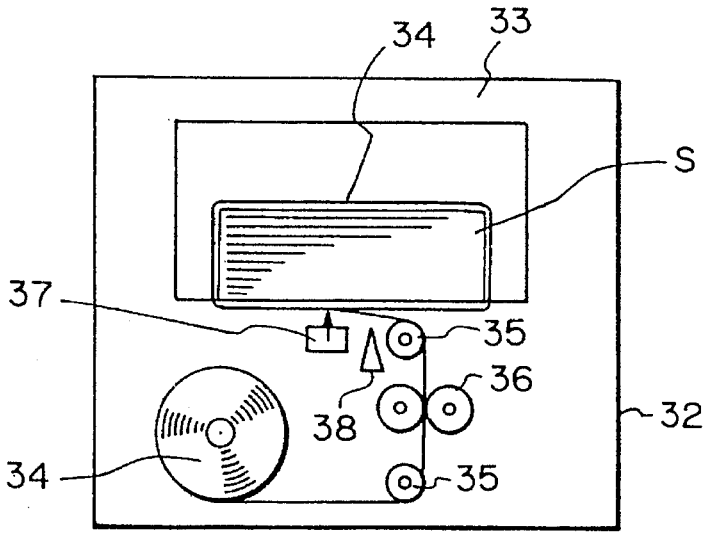

FIG. 11B is a view showing a situation in which the band 34 pulled by the supply roller 36 has come out of the band guide 33 and is in the process of winding around the sheets of cut paper S. The, the band 34 winds around the sheets of cut paper P with an appropriate force as shown in FIG. 11C to a condition shown in FIG. 11B. After that, the band 34 is cut by the cutter 38, and then the fore end of the band 34 is thermally fused with a middle portion of the band 34 itself, so that a band 39 can be formed around the sheets of cut paper S so as to bind them. The tying processing portion 31 shown in FIG. 3 controls the operations shown in FIGS. 11A to 11C.

Figure 12:
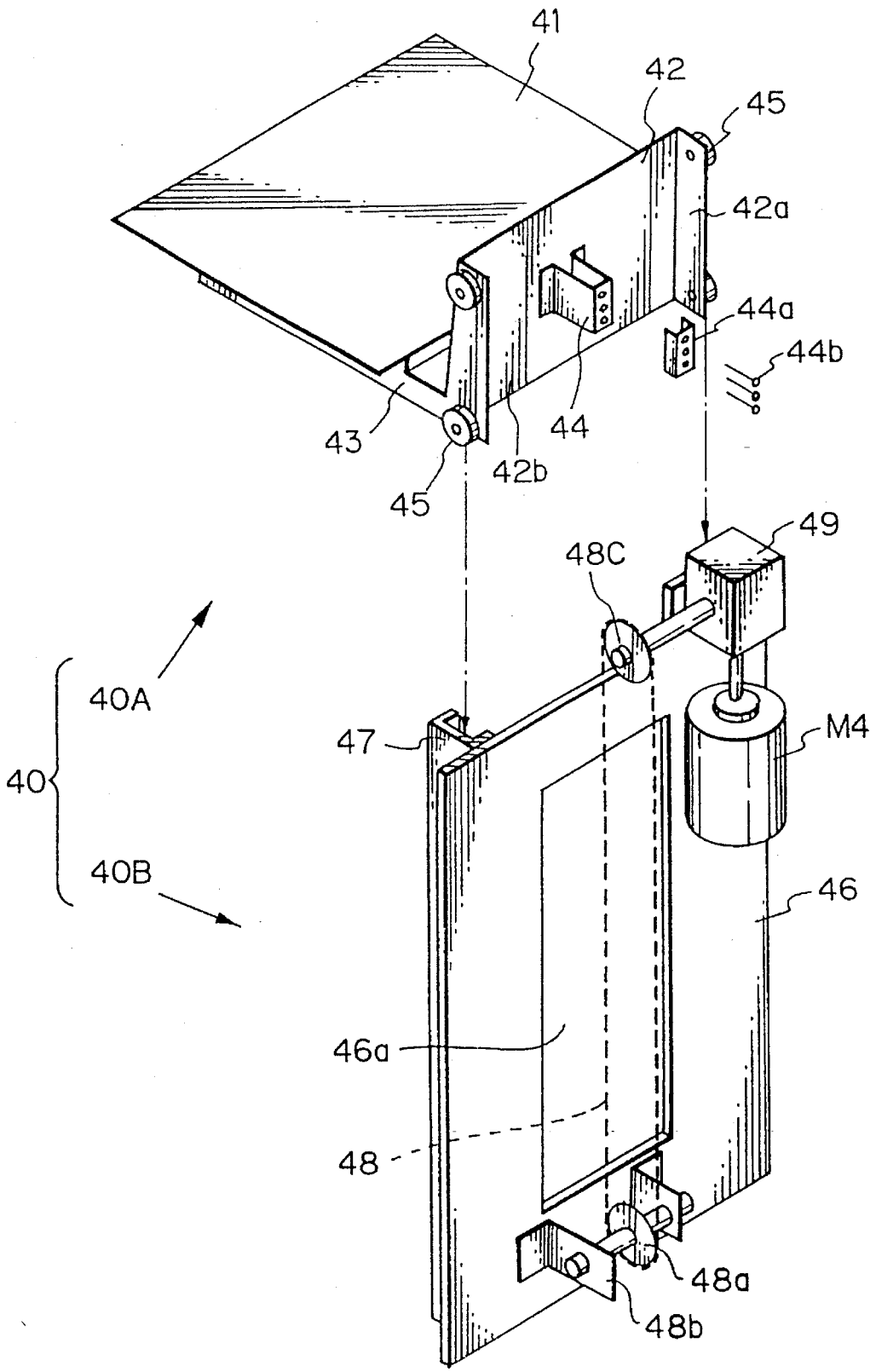
FIG. 12 is a perspective assembly view showing the structure of the output table in FIG. 2.
Figure 13:
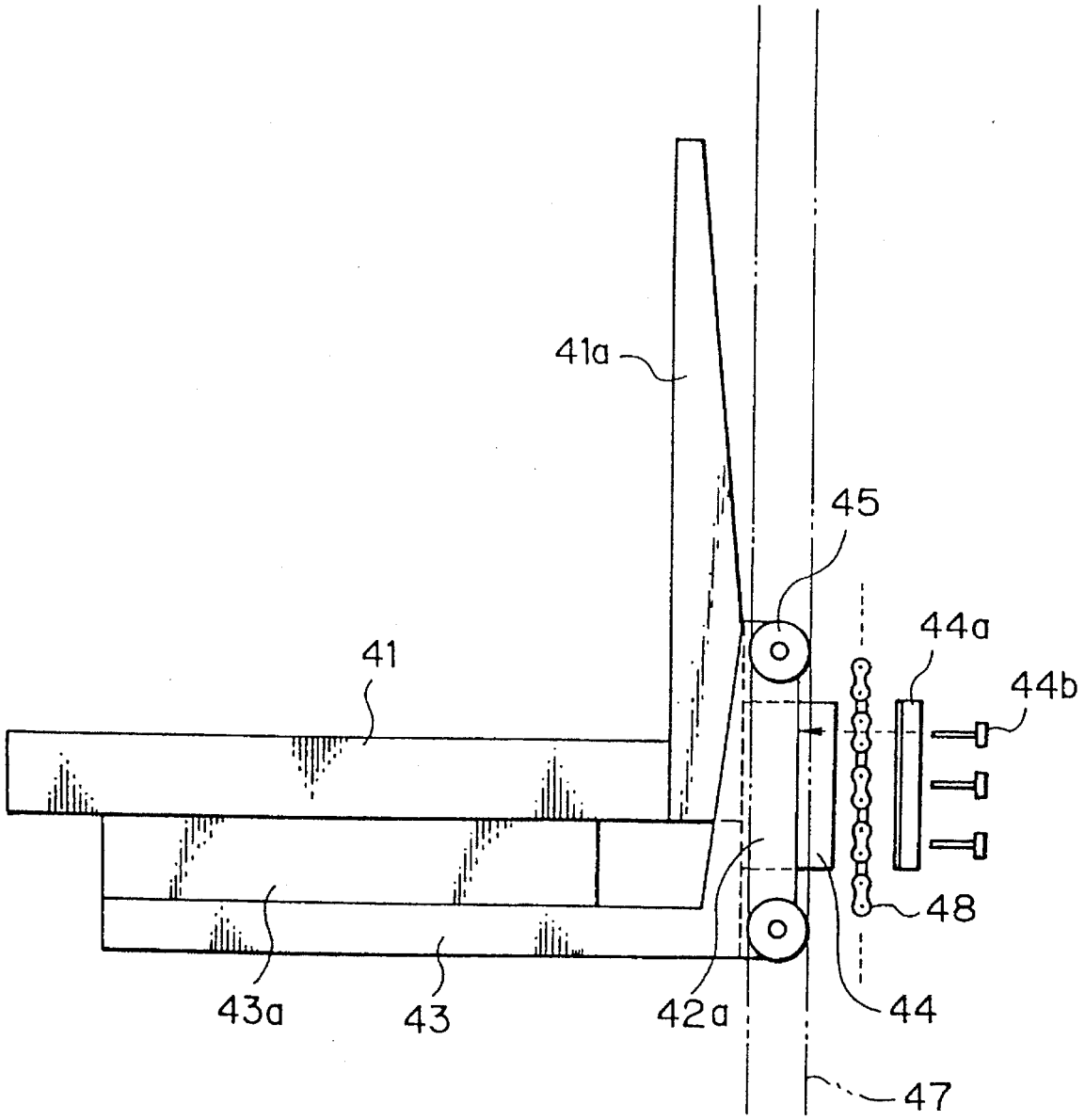
FIG. 13 is a schematic illustration for explaining a fastening condition in which the output table in FIG. 12 is fastened to the drive mechanism of an elevation table.

FIGS. 12 and 13 are views showing the construction of the output portion 40. The output portion 40 is provided with an elevation portion 40A and a base portion 40B, and the elevation portion 40A elevates along the base portion 40B.

The elevation portion 40A includes an elevation frame 42, and two arms 43 protrude from the front surface of a back plate 42*b* of this elevation frame 42. The elevation table 41 is mounted on these two arms 43 through a spacer 43*a*. On the upper surface of the elevation table 41, there is provided a guide plate 41*a* to align the ends of sheets of cut paper S stacked on the upper surface. On the side plates 42*a* of the elevation frame 42, there are provided four wheels 45, wherein two of them are provided on one side, and the other two are provided on the other side. Further, a bracket 44 protrudes from the back plate 42*b* of the elevation frame 42 so that a chain 48 provided on the base 40B side can be fixed by the bracket 44.

In the base unit 40B, on the front surface side of the casing 46, U-shaped rails 47 are provided in such a manner that the open sides of the U-shaped rails are opposed to each other. An opening 46*a* is formed in the casing 46 between the two rails 47. The elevation unit 40A is attached to the base unit 40B under the condition that the wheels 45 are inserted into the rails 47. In this drawing, an outline of the casing of the base portion 40B is shown, so that the ceiling plate, bottom plate and side plate are not shown. In this example, a bracket 48*b* is provided on the casing 46, and a sprocket 48*a* is rotatably provided in the bracket 48b. On the other hand, a not shown bracket is provided on a not shown ceiling plate of the casing 46. A sprocket 48*c* is rotatably provided in this bracket. The chain 48 is provided between the two sprockets 48*a* and 48*c*.

In the casing 46, there is provided a motor M4 which is upwardly attached to the casing 46 through a bracket. The rotational shaft of the motor M4 rotates the sprocket 48*c* mounted on the ceiling board of the casing 46, through a reduction gear mechanism 49 having a worm gear mechanism.

As shown in FIG. 13, the chain 48 is fixed to the bracket 44 protruded from the back plate 42*b* of the elevation unit 40A in such a manner that the chain 48 is interposed between the bracket 44 and a chain fixing plate 44*a*, and a bolt 44*b* is inserted into the bracket 44 and the chain fixing plate 44*a*.

In the output unit 40 constructed as described above, when the motor M4 is driven, the chain 48 is rotated, and the elevation unit 40A fixed to the chain 48 is elevated with respect to the base unit 40B. A sensor not shown is provided between the elevation unit 40A and the base unit 40B. As explained in FIG. 3, the controller 20 controls the rotation of the motor M4 by the detection output of the sensor in accordance with the position of the elevation unit 40A with respect to the base unit 40B. This output unit 40 functions as a stock section in which the sheets of printed cut paper S are stocked so as to be taken out after they have been tied with a band.

In the binding apparatus B constructed in the manner described above, the conveyance arm 10 conveys sheets of printed cut paper S to the tying machine 30 for each job offset, then the sheets of printed cut paper S are tied with a band. After that, the tied sheets of cut paper S are conveyed onto the output table 41 of the output unit 40 and stocked. The series of operations described above are controlled by the controller 20 in the printing machine mechanism control unit 100 shown in FIG. 3 that integrally controls the entire system.

Figure 14A:
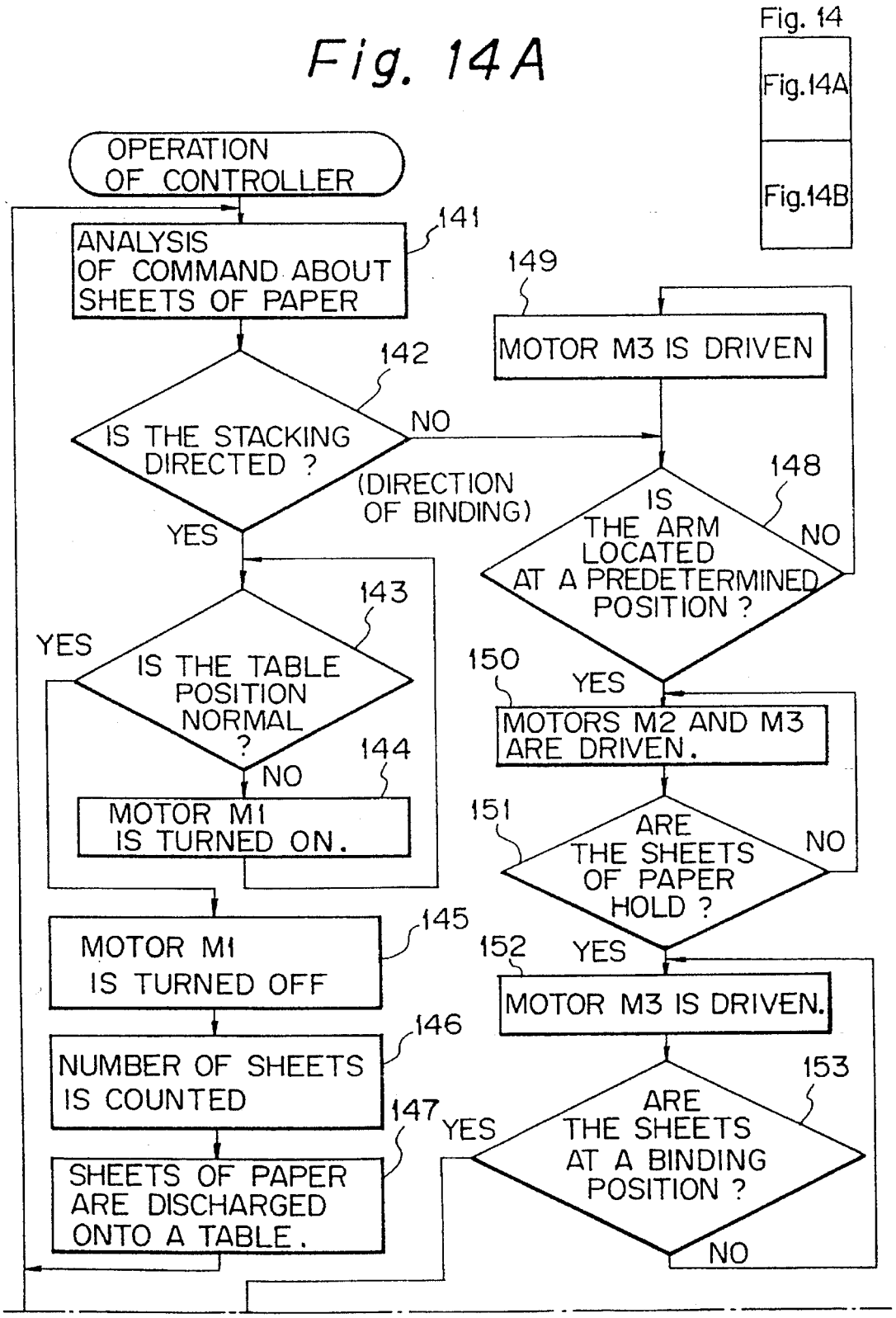
FIGS. 14A and 14B are flowcharts showing the procedure of the binding apparatus of an example constructed as shown in FIG. 2.
Figure 14B:
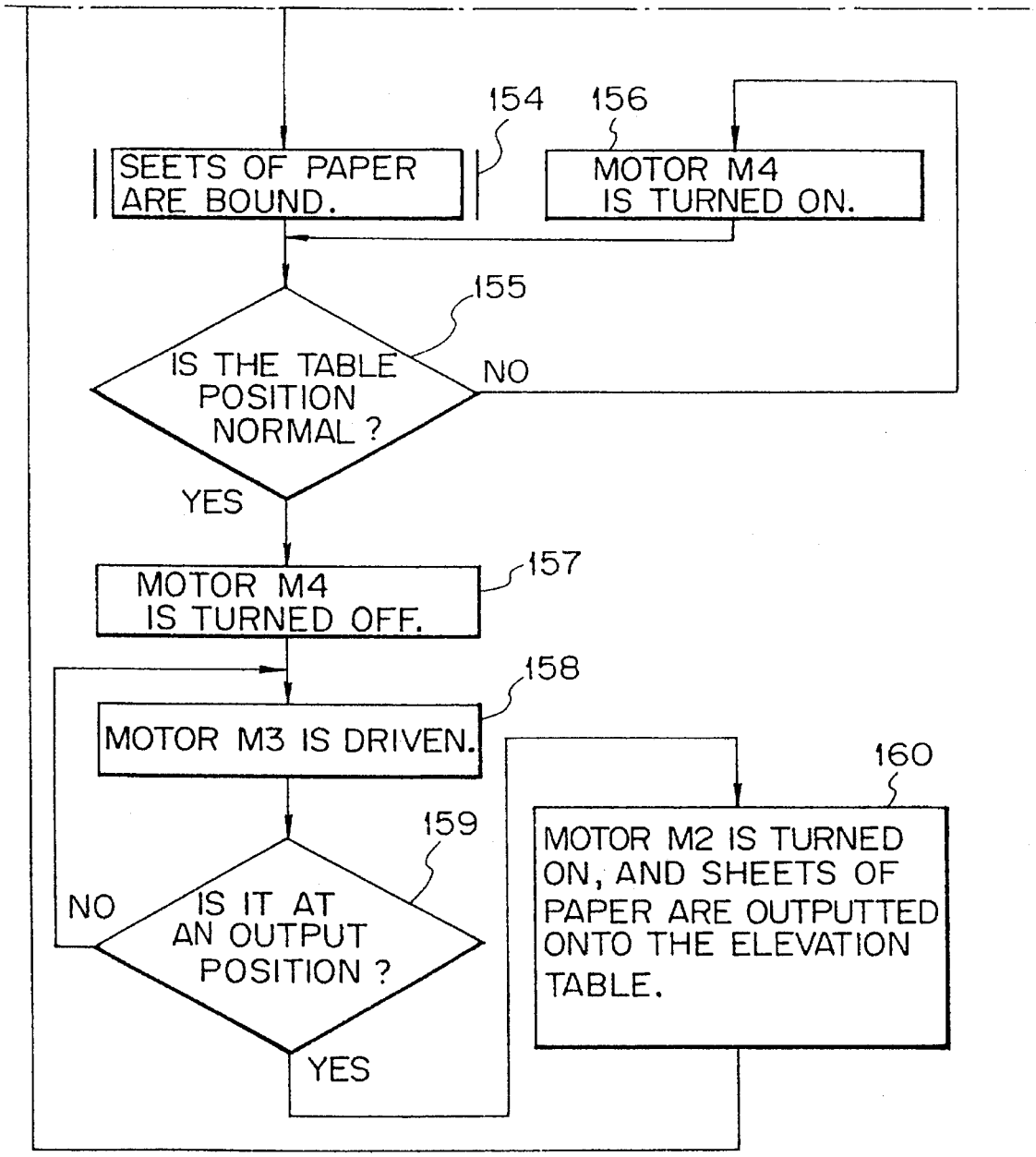

Next, with reference to the arrangement views shown in FIGS. 2 and 3, the flowchart shown in FIGS. 14A and 14B, and the schematic illustrations for explaining the tying operations shown in FIGS. 15A to 15D, an example of the control operation conducted by the controller 20 in FIG. 3 will be explained as follows. In this connection, in the schematic illustrations for explaining the tying operations shown in FIGS. 15A to 15D, concerning the conveyance arm 10, only its operation is illustrated, and its substantial configuration is not illustrated.

(1) When sheets of cut paper S printed in the printing machine P are conveyed to the binding apparatus B through the conveyance roller $R_0$, a sensor not shown detects the movement of the sheets of cut paper S. From the result of the detection, the controller 20 analyzes a command sent from the printing machine mechanism control section 100 in step 141. This analysis is conducted in accordance with the command sent from the printing machine mechanism control section 100, and it is judged whether the sheets of cut paper S in a conveyance operation are directed to be stacked or to be bound.

(2) At the beginning, the job is to be carried out. Therefore, in step 142, a command of stacking is judged, and the program advances to step 143. Then, stacking operations shown in steps 143 to 147 are carried out in the binding apparatus B. At this time, in step 143, the controller 20 judges in accordance with the result of detection of a sensor not shown whether or not the elevation table 91 of the stack table 9 is stopped at a normal position. When the elevation table 91 is not located at the normal position, the program advances to step 144, and the stack table operation motor M1 is controlled to be turned on. Then, the program returns to step 143, and it is judged whether or not the elevation table 91 is located at the normal position.

When it has been judged in step 143 that the elevation table 91 is located at the normal position, the program advances to step 145, and the stack table operation motor M1 is turned off. In the case where the elevation table 91 is located at the normal position, the number of sheets of cut paper S is counted in step 146, and in the following step 147, the sheets of printed cut paper S are discharged onto the elevation table 91, so that the sheets of cut paper S are successively stacked on the elevation table 91. After one job has been completed as described above, the program returns to step 141, and the sheets of cut paper S are stacked on the elevation table 91 until a command to bind the sheets of cut paper S is transmitted from the printing machine mechanism control unit 100.

(3) After, one job for a job-offset unit has been completed, a command to bind the sheets is transmitted to the controller 20 from the printing machine mechanism control unit 100. Then, after the last sheet of the job has been outputted onto the stack table, the command to bind is judged in step 142, and the program advances to step 148. Then, in steps 148 to 160, the controller 20 conducts a binding operation on the sheets of cut paper S.

Figure 15A:
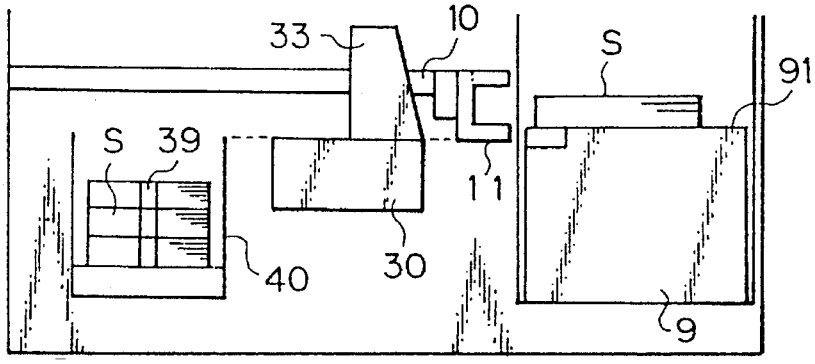
FIGS. 15A to 15D are schematic illustrations for explaining the operation of the binding apparatus shown in FIG. 2 in accordance with the flow chart shown in Figs. 14A and 14B.

(4) In a binding operation of the sheets of cut paper S, first, it is judged by a sensor not shown in the drawings whether or not the conveyance arm 10 is located at a predetermined position (in a ready condition of the conveyance arm) in which the conveyance arm 10 is located close to the stack table 9 as shown in FIG. 15A. If the conveyance arm 10 is not in the ready condition, the conveyance arm drive motor M3 is controlled so that the conveyance arm 10 can be set in the ready condition.

Therefore, in step 148, it is judged whether or not the conveyance arm 10 is located at the predetermined position. When the conveyance arm 10 is located at the predetermined position, the program advances to step 150, and when the conveyance arm 10 is not located at the predetermined position, the program advances to step 148, and the motor M3 is driven. Drive of the motor M3 is continued until the conveyance arm 10 reaches the predetermined position.

Figure 15B:
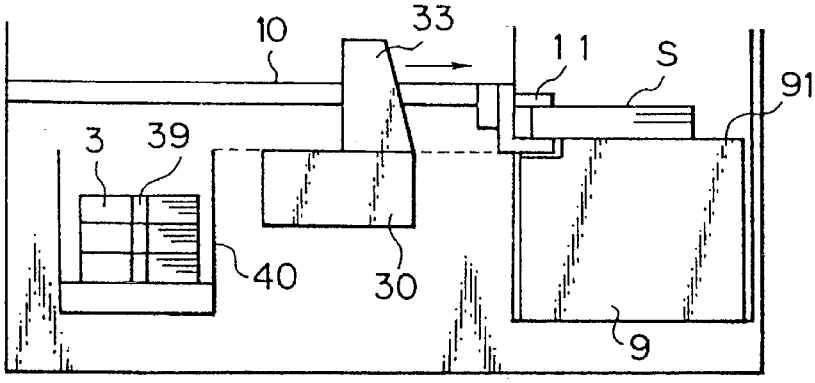

(5) When the conveyance arm 10 is located in the ready condition as shown in FIG. 15A, the controller 20 controls the conveyance arm drive motor M3 in step 150 so that the conveyance arm can be slightly moved onto the stack table 9 side, and the hand portion 11 of the conveyance arm 10 is set at the upper and lower positions of the sheets of cut paper S. Then, the conveyance arm holding control motor M2 is driven, so that the hand portion 11 of the conveyance arm 10 holds the sheets of cut paper S as shown in FIG. 15B. When the sheets of cut paper S are positively held by the hand portion 11, a signal of completion of holding is sent out from the hand portion 11.

The above operations are carried out in steps 150 and 151. When the signal of completion of holding is sent out from the hand portion 11, the program advances to step 152 from step 151.

Figure 15C:
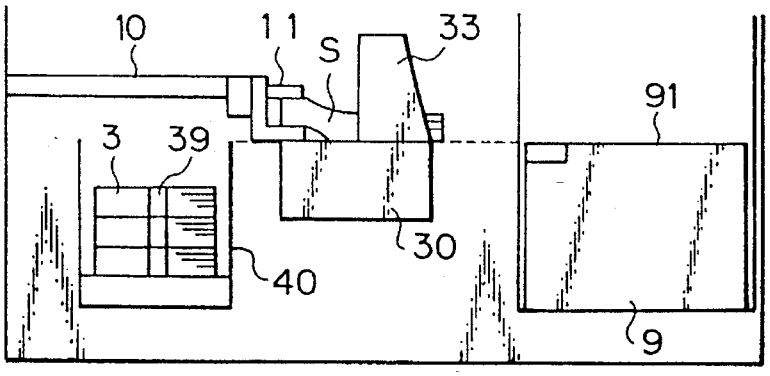

(6) After the hand portion 11 of the conveyance arm 10 has held the sheets of cut paper S, the conveyance arm drive motor M3 is driven so that the sheets of cut paper S are conveyed to a tying position (a binding position) of the tying machine 30 as shown in FIG. 15C while the conveyance arm 10 is holding the sheets of cut paper S. When it is judged by a sensor not shown in the drawings that the bundle of sheets of cut paper S have been conveyed to the tying position of the tying machine 30, rotation of the conveyance drive motor M3 is stopped, so that the conveyance arm 10 is temporarily stopped at this tying position.

The above operations are carried out in steps 152 and 153. When the bundle of sheets of cut paper S are conveyed to the tying position of the tying machine 30, the program advances to step 154 from step 153.

(7) In step 154, the bundle of sheets of cut paper S are bound when they are tied with a band by the tying machine 30. After this tying operation has been completed, a signal of completion of tying is outputted to the controller 20 from the tying machine 30, and then the controller 20 carries out the subsequent processing.

(8) The bundle of sheets of cut paper S that have been tied up with a band are conveyed onto the output table 40 side by the conveyance arm 10 when the conveyance arm drive motor M3 is driven. Before the bundle of sheets of cut paper S tied up with a band are conveyed onto the output table 40 side, it is judged by a sensor not shown in the drawing whether or not the elevation table 41 of the output table 40 is in a table-ready condition in which the elevation table 41 is located at a normal position. When the elevation table 41 is not located at the normal position, the controller 20 controls the output table operation motor M4 to be turned on so that the elevation table 41 can be located at the normal position (in the table-ready condition).

This operation is carried out in steps 155 and 156. After the elevation table 41 has been controlled so that it can be located at the normal position, the program advances to step 157 from step 155, and then the output table operation motor M4 is turned off.

Figure 15D:
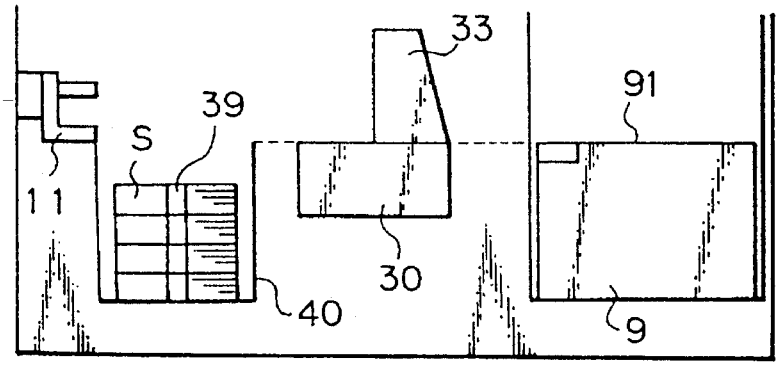

(9) In the case where the elevation table 41 is located in the table-ready condition as described above, the bundle of sheets of cut paper S that have been tied with a band are stacked on the elevation table 41 of the output table 40 when the hand portion 11 of the conveyance arm 10 is released. Release of the tied bundle of sheets of cut paper S from the hand portion 11 can be judged from a signal of completion of opening that has been outputted from the hand portion 11. In the manner described above, a new bundle of sheets are stacked on the elevation table 41 of the output table 40 as shown in FIG. 15D. After that, the controller 20 controls the conveyance arm drive motor M3, and returns the conveyance arm 10 to the condition shown in FIG. 15A. Then, the conveyance arm 10 waits for the next operation.

The aforementioned operation is carried out in steps 158 to 160, and after the operation of step 160 has been completed, the program returns to step 141.

Next, the second example of the present invention will be explained with reference to FIGS. 16A, 17A, 17B and 17C. In the second example, the number of tied bands can be selected. In the case where a large number of sheets of cut paper S are printed for one job, it is not sufficient to bind a bundle of sheets with only one band. Also, in some cases, it is not sufficient to bind a bundle of sheets with only one band according to the size and type of the sheets of cut paper S. In order to solve these problems, the number of bands is not limited to one, but a plurality of bands can be applied in the second example. In the construction of the second example, not only can the number of bands be automatically set, but also an operator of the printing machine P can designate the number of bands. Therefore, a selection can be made between the automatic setting and the manual setting, being designated by the operator.

Figure 16A:
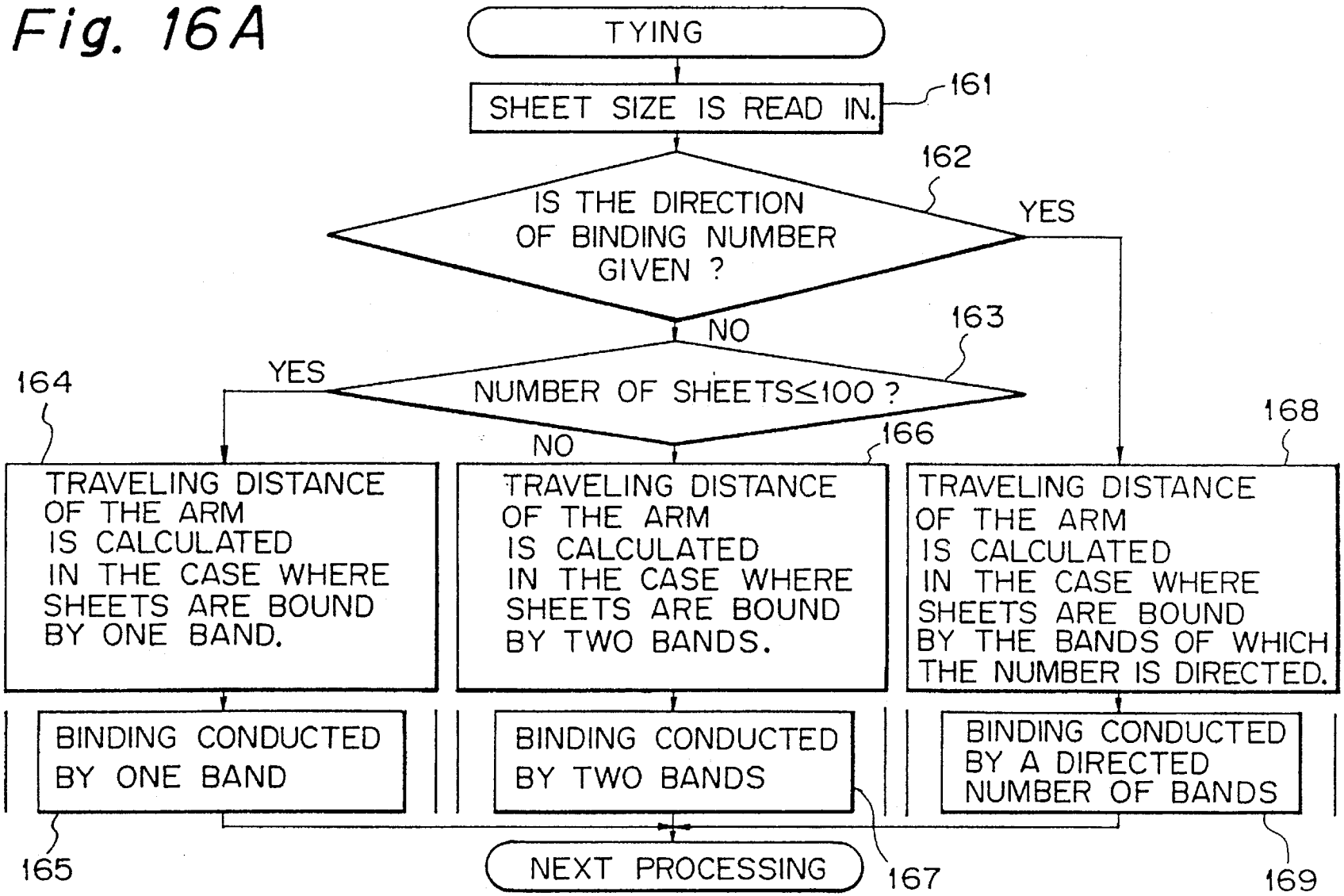
FIG. 16A is a flowchart showing the procedure of the second example which shows the procedure of tying processing in the binding apparatus of the example constructed as shown in FIG. 2.

A control procedure of the second example will be explained with reference to the flowchart shown in FIG. 16A. The operations of the second example except for the operation of the tying process are approximately the same as those explained in FIGS. 14A and 14B. Therefore, the operation of the tying process will be mainly explained, and other operations are omitted here. When a bundle of sheets are tied with a plurality of bands, the tying positions are different according to the size of sheets. Therefore, for example, data of the tying positions determined by the size of sheets is previously inputted in the form of a table and stored in the ROM 24 and RAM 23 of the controller.

In step 161, the size of sheets of cut paper S is read in. This sheet size may be inputted by an operator through a keyboard. Alternatively, the sheet size may be automatically detected in a printing process and notified. In the following step 162, it is judged whether or not the number of tied bands has been inputted by the operator. In the case where the number of bands has been inputted by the operator, this command is given priority, so that the directed number of bands are applied to tie the bundle of sheets. In the case where the number of bands has not been directed by the operator, the program advances to step 163. In step 163, it is judged whether or not the number of sheets of cut paper S to be bound is not more than 100. As explained in step 146 shown in FIGS. 14A and 14B, the number of sheets of cut paper S to be bound may be counted in a discharging process in which the sheets of cut paper S are discharged onto the stack table.

In the case where the number of sheets of cut paper S is not more than 100, it is sufficient to bind the sheets with one band. Therefore, the program advances to step 164, and a traveling distance of the conveyance arm 10 is calculated in the case where the bundle of sheets are bound with one band. In the case where the number of bands is one, the traveling distance of the conveyance arm 10 is calculated so that the band can be applied to the center of the sheets of cut paper S. In the subsequent step 165, the bundle is bound with one band.

In the case where the number of sheets of cut paper S to be bound exceeds 100, it is not sufficient to bind them with one band. Therefore, it is judged that two bands are necessary for binding them, and the program advances to step 166.

Then, a traveling distance of the conveyance arm 10 is calculated in the case where the sheets are bound with two bands. In the case where two bands are applied, the traveling distance of the conveyance arm 10 is previously stored in accordance with the sheet size. Then, in the subsequent step 167, the sheets are bound with two bands.

On the other hand, when it is judged in step 162 that the operator has directed the number of bands, the program advances to step 168, and a traveling distance of the conveyance arm 10 is calculated in the case where the sheets are bound with the bands, the number of which has been directed by the operator. In the case where the number of bands is directed by the operator, the traveling distance of the conveyance arm 10 is previously stored in accordance with the sheet size. Then, in the subsequent step 169, the sheets are bound with the bands, the number of which has been designated. In this connection, in the case where the number of bands is determined by the direction of the operator, for example, the number is previously inputted through the key board 27 shown in FIG. 3.

FIGS. 17A to 17D are schematic illustrations for explaining situations of the tying machine 30 by which the sheets are bound with two bands. In this case, in step 166 shown in FIG. 16A, the traveling distances X and Y of the conveyance arm 10 from the stack table 9 are previously calculated in the case where the sheets are bound with two bands.

Figures 17A, 17B, 17C:
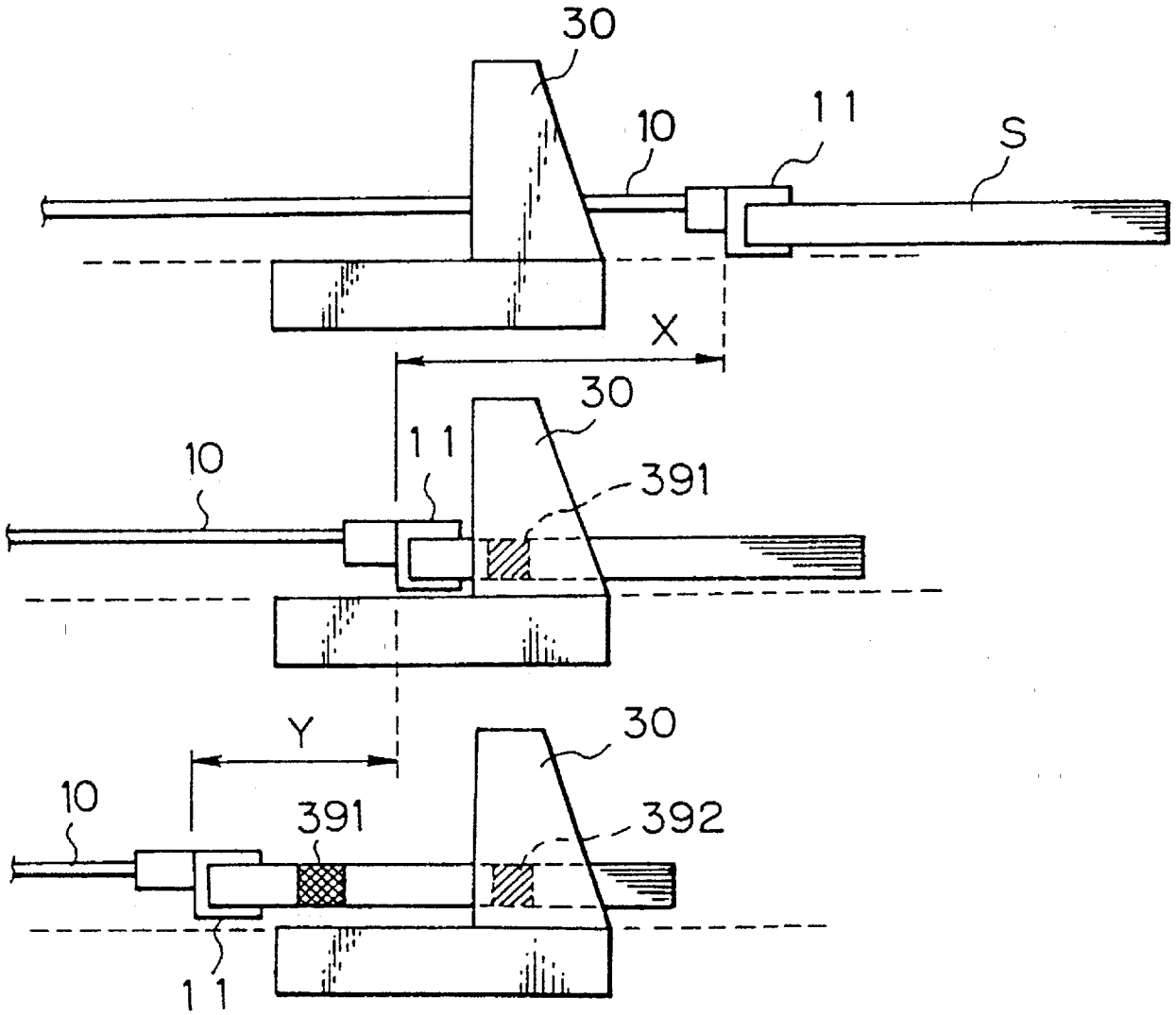
FIGS. 17A to 17C are schematic illustrations for explaining the operation of the binding apparatus in FIG. 2 in accordance with the flowcharts shown in FIGS. 16A to 16C.

In this case, first, the sheets of printed cut paper S are moved for a distance X by the conveyance arm 10 to the tying machine 30 side from a position at which the sheets are held by the conveyance arm 10 on the stack table as shown in FIG. 17A. At a position indicated by hatched lines in FIG. 17B, the first band 391 is applied to the bundle of sheets. After the band 391 has been applied, the sheets of cut paper S are further moved for a distance Y by the conveyance arm 10 and stopped, and then the second band 392 is applied at a position indicated by hatched lines in FIG. 17C. After the band 392 has been applied, the sheets of cut paper P are moved again onto the elevation table 41 of the output table 40.

In this connection, in the aforementioned second example, the number of sheets may be controlled to determine the number of bands in the following manner. For example, in the case where the number of sheets is not more than 100, the sheets are bound with one band, and in the case where the number of sheets is 101 to 500, the sheets are bound with two bands. Alternatively, in an apparatus having the conveyance arm 10, a sensor to detect the thickness of sheets may be provided in the hand portion 11, and when the hand portion 11 holds the sheets of cut paper, the thickness of the sheets may be detected to determine the number of bands to be applied. Further, a sensor to detect the height of printed sheets may be provided on the stack table 9 on which the sheets of cut table S are temporarily stacked, and the number of bands to be applied may be determined in accordance with the height of the stacked sheets.

Figure 16B:
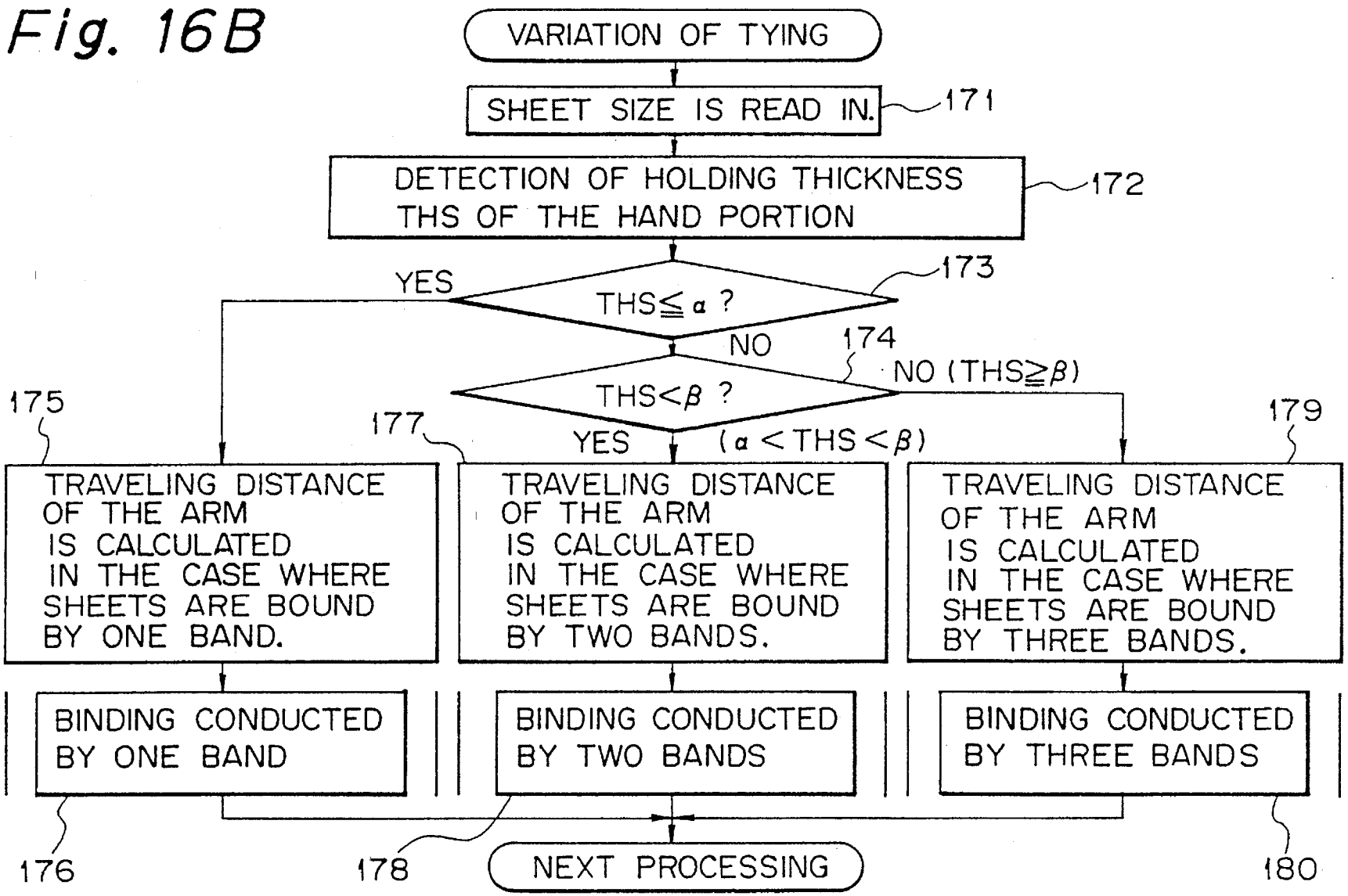
FIGS. 16B and 16C are flowcharts showing the procedure of tying processing in a variation of the example shown in FIG. 16A.

FIG. 16B is a flowchart showing a control procedure to determine the number of bands in which a sensor to detect the thickness of the sheets held by the hand portion 11 of the conveyance arm 10 is provided and the number of bands to be applied is determined in accordance with the result of the detection.

In step 171, the size of sheets of cut paper S is read in. In the subsequent step 172, the thickness THS of the sheets held by the hand portion 11 is detected. In step 173, it is judged whether or not the thickness THS detected in the hand portion 11 is not more than the thickness $\alpha$ corresponding to 100 sheets of cut paper S. In the case where THS>$\alpha$, the program advances to step 174, and it is judged whether or not the thickness THS detected in the hand portion 11 is not more than the thickness $\beta$ corresponding to 500 sheets of cut paper S to be bound.

In the case where THS$\leqq\alpha$, it is sufficient to apply only one band, so that the program advances to step 175, and a travel distance of the conveyance arm 10 is calculated in the case where the sheets are bound with one band, and in the subsequent step 176 the sheets are bound with one band. In the case where $\alpha$<THS<$\beta$, the number of sheets to be bound is 100 to 500. Therefore, it is judged that two bands are required to bind the sheets, and the program advances to step 177, and a travel distance of the arm 10 is calculated in the case the sheets are bound with two bands. In the subsequent step 178, the sheets are bound with two bands. In the case where THS$\geqq\beta$, the number of sheets to be bound is not less than 500. Therefore, it is judged that three bands are required, and the program advances to step 179. Then, a travel distance of the conveyance arm 10 is calculated in the case where the sheets are bound with three bands. Then, in the subsequent step 180, the sheets are bound with three bands.

Figure 16C:
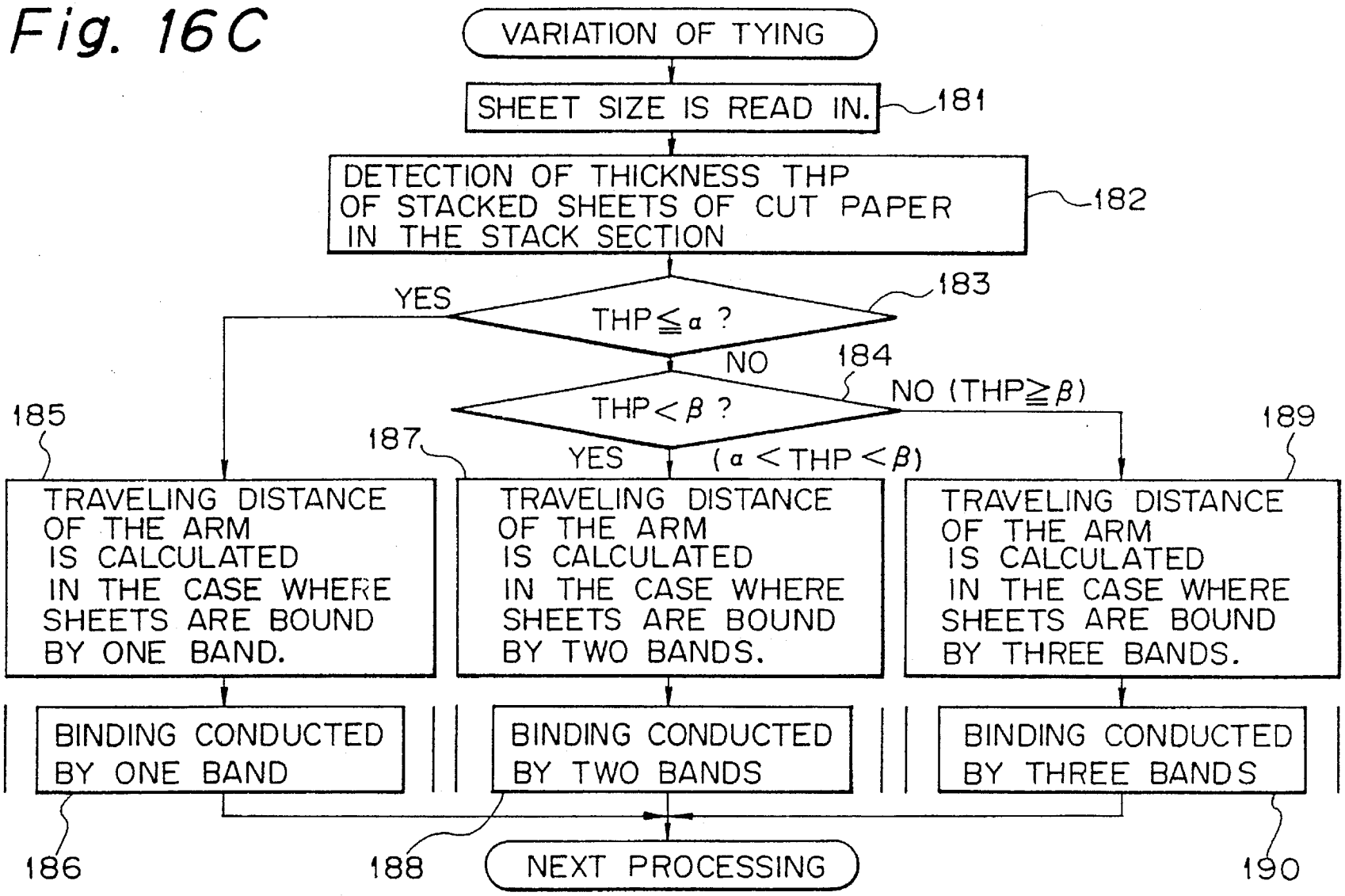

FIG. 16C is a flowchart showing a control procedure in which a sensor to detect the height of sheets of printed cut paper is provided on the stack table 9 on which the sheets are temporarily stacked, and the number of bands to be applied is determined by the height of stacked sheets of cut paper S.

In step 181, the size of sheets of cut paper S is read in. In the subsequent step 182, the height THP of the sheets of printed cut paper S temporarily stacked on the stack table 9 is detected. In step 183, it is judged whether or not the height THP detected on the stack table 9 is not more than the thickness $\alpha$ corresponding to 100 sheets of cut paper S. In the case where THS>$\alpha$, the program advances to step 184, and it is judged whether or not the height THP of the sheets of cut paper S is not more than the thickness $\beta$ corresponding to 500 sheets of cut paper S to be bound.

In the case where THS$\leqq\alpha$, it is sufficient to apply only one band, so that the program advances to step 185, and a travel distance of the conveyance arm 10 is calculated in the case where the sheets are bound with one band, and in the subsequent step 186 the sheets are bound with one band. In the case where $\alpha$<THS<$\beta$, the number of sheets to be bound is 100 to 500. Therefore, it is judged that two bands are required to bind the sheets, and the program advances to step 187, and a travel distance of the arm 10 is calculated in the case the sheets are bound with two bands. In the subsequent step 188, the sheets are bound with two bands. In the case where THS>$\beta$, the number of sheets to be bound is not less than 500. Therefore, it is judged that three bands are required, and the program advances to step 189. Then, a travel distance of the conveyance arm 10 is calculated in the case where the sheets are bound with three bands. Then, in the subsequent step 190, the sheets are bound with three bands.

Next, with reference to FIGS. 18A and 18B, the third example of the present invention will be explained. For example, in some cases, bar codes used for sorting or addresses are printed on the sheets of outputted cut paper S. In this case, when a band is applied to the center of the sheets of cut paper S, the bar codes or addresses printed on the sheets are covered with the band. In order to overcome the aforementioned disadvantages, the binding position can be arbitrarily determined in this example.

In the case where only one band is applied as shown in

Figure 18A:
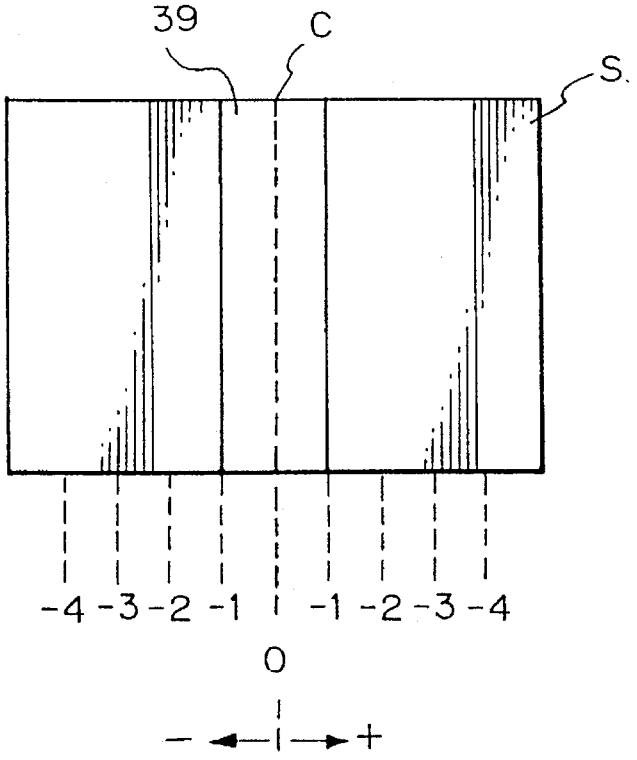
FIG. 18A is a schematic illustration of the third example of the present invention for explaining a setting position of the tying position in the binding apparatus shown in FIG. 2.
Figure 18B:
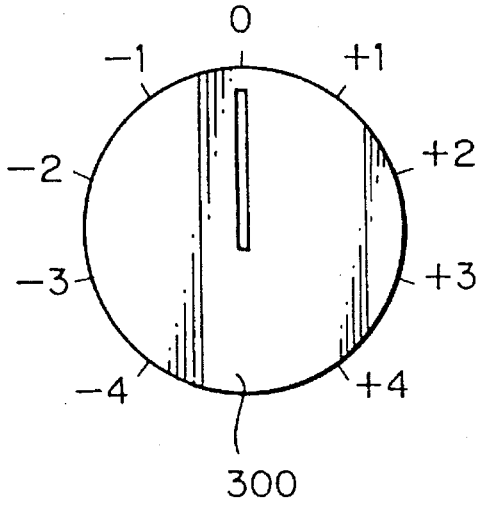
FIG. 18B is a schematic illustration of a switch for explaining a setting position of the tying position in the binding apparatus shown in FIG. 2.

FIG. 18A, the center of the bundle of sheets of cut paper S indicated by character 0 is used as a reference position at which the band is set. In the case where the sheets are bound with two bands, a region on the sheet surface from the center 0 to the edge is equally divided into 5 portions as shown in 18A, so that the portions of +1 to +4 and −4 to −1 can be set. The setting of the portions of +1 to +4 and −4 to −1 can be conducted, for example, by a digital switch 300 shown in FIG. 18B so as to designate the binding position. In the aforementioned manner, the binding position of the band 39 can be designated even when the sheet size is different. Therefore, the sheets can be bound with the band 39 without covering a specific portion printed on the sheets of cut paper S.

FIGS. 19A to 21B are views showing the fourth example of the present invention. In the binding apparatus B of the present invention, in the case where a small number of sheets, or thin and soft sheets are bound with the band 39, the sheets of cut paper S are bent or curled by a force applied to the band 39.

In order to solve the aforementioned problems, in this fourth example, at the tying position of the tying machine 30, there are provided sheet width guides 301, 302 that function as an auxiliary plate for tying the sheets of cut paper S without causing deflection.

Figure 19A:
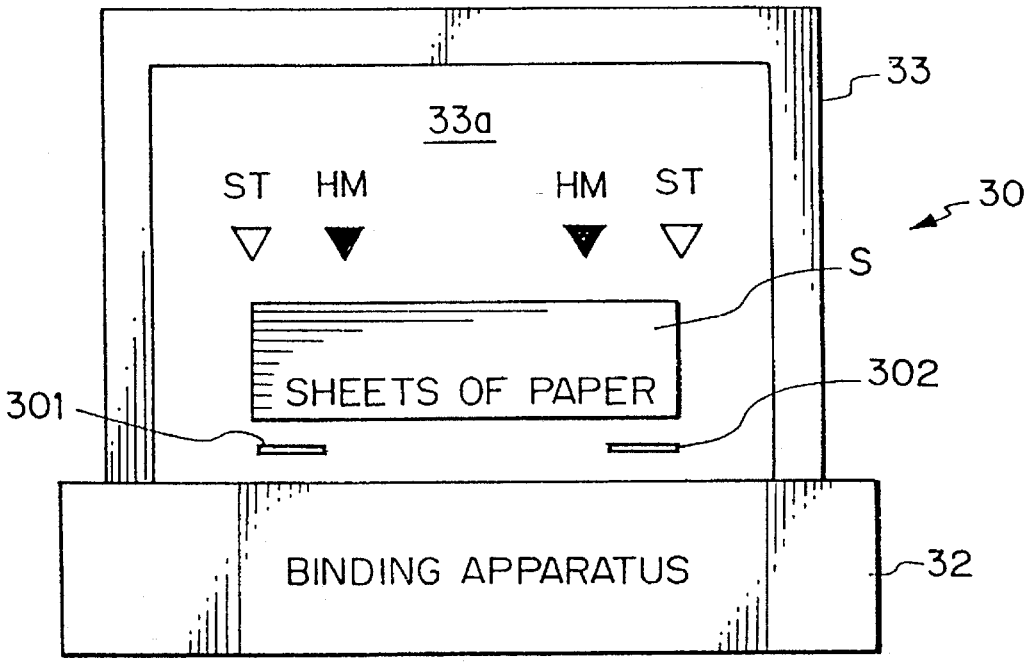
FIG. 19A is a schematic illustration for explaining the structure of the fourth example of the present invention in which a sheet width guide is provided in the binding apparatus shown in FIG. 9.
Figure 19B:
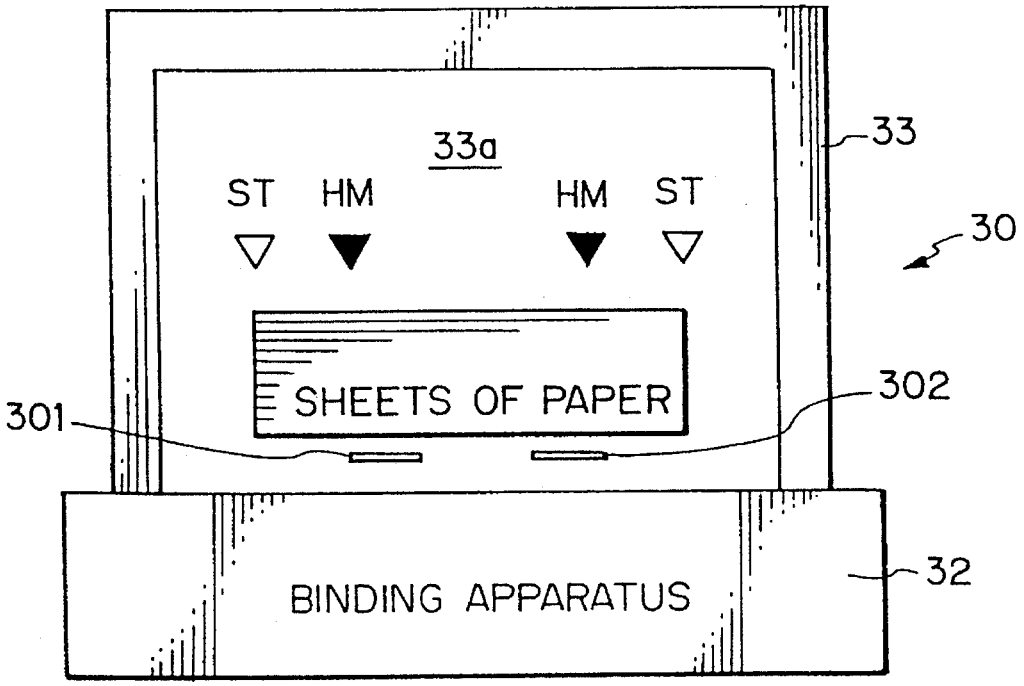
FIG. 19B is a schematic illustration for explaining the operation of the sheet width guide of the fourth example shown in FIG. 19A.
Figure 21A:
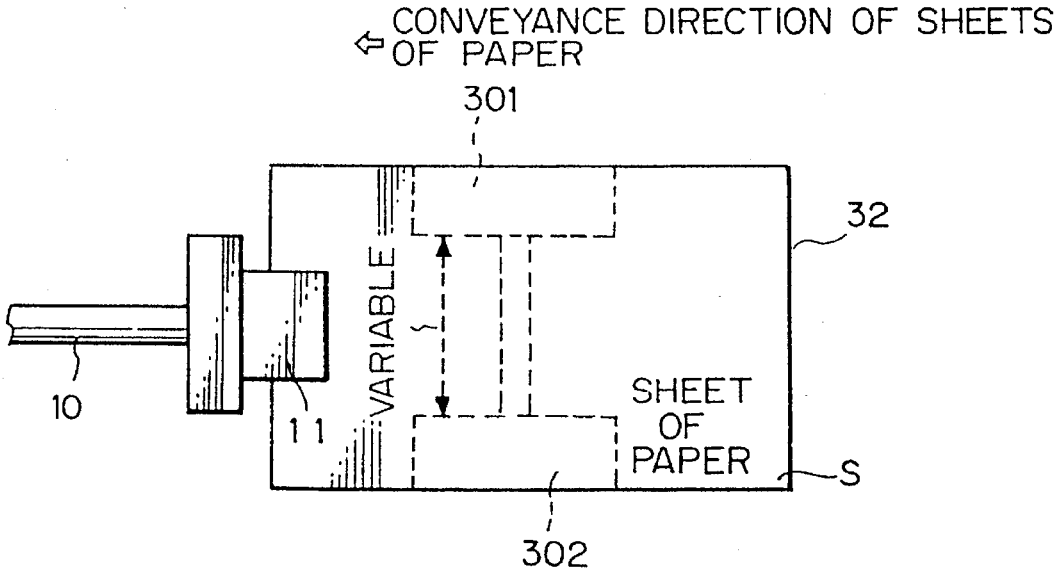
Figure 21B:
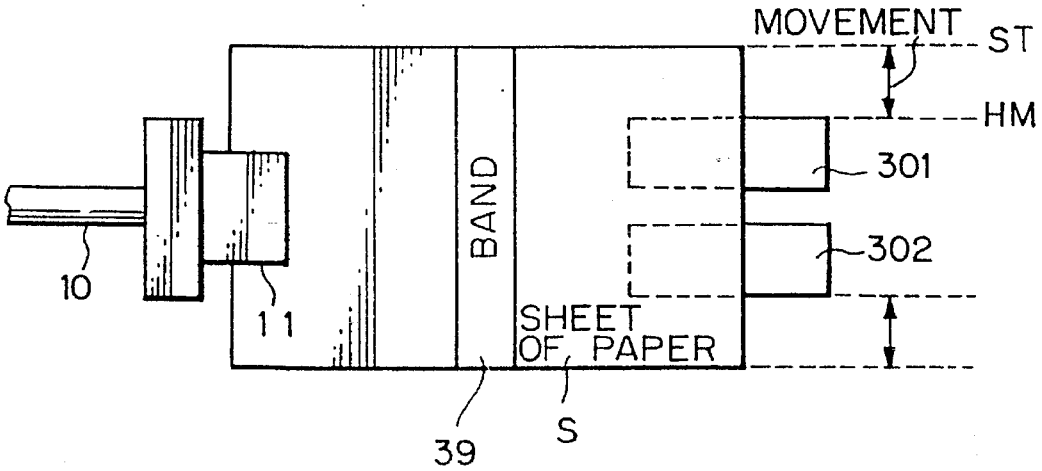

In more detail, as shown in FIGS. 19A, 19B, 21A and 21B, two sheet guides 301, 302 are provided at positions in the tying machine 30 where the bundle of sheets of cut paper S are located. With respect to these two sheet width guides 301, 302, the setting position ST shown in FIGS. 19A, 21A and the home position HM shown in FIGS. 19B, 21B are set. In this connection, in FIGS. 19A and 19B, a black triangular mark represents the home position HM, and a white triangular mark represents the setting position ST. At the setting positions ST, the sheet width guides 301, 302 are placed at the same width as that of the sheets of cut paper S. At the home positions HM, the two sheet width guides 301, 302 are placed so that the width becomes smaller than that of the setting position ST.

Figure 20:
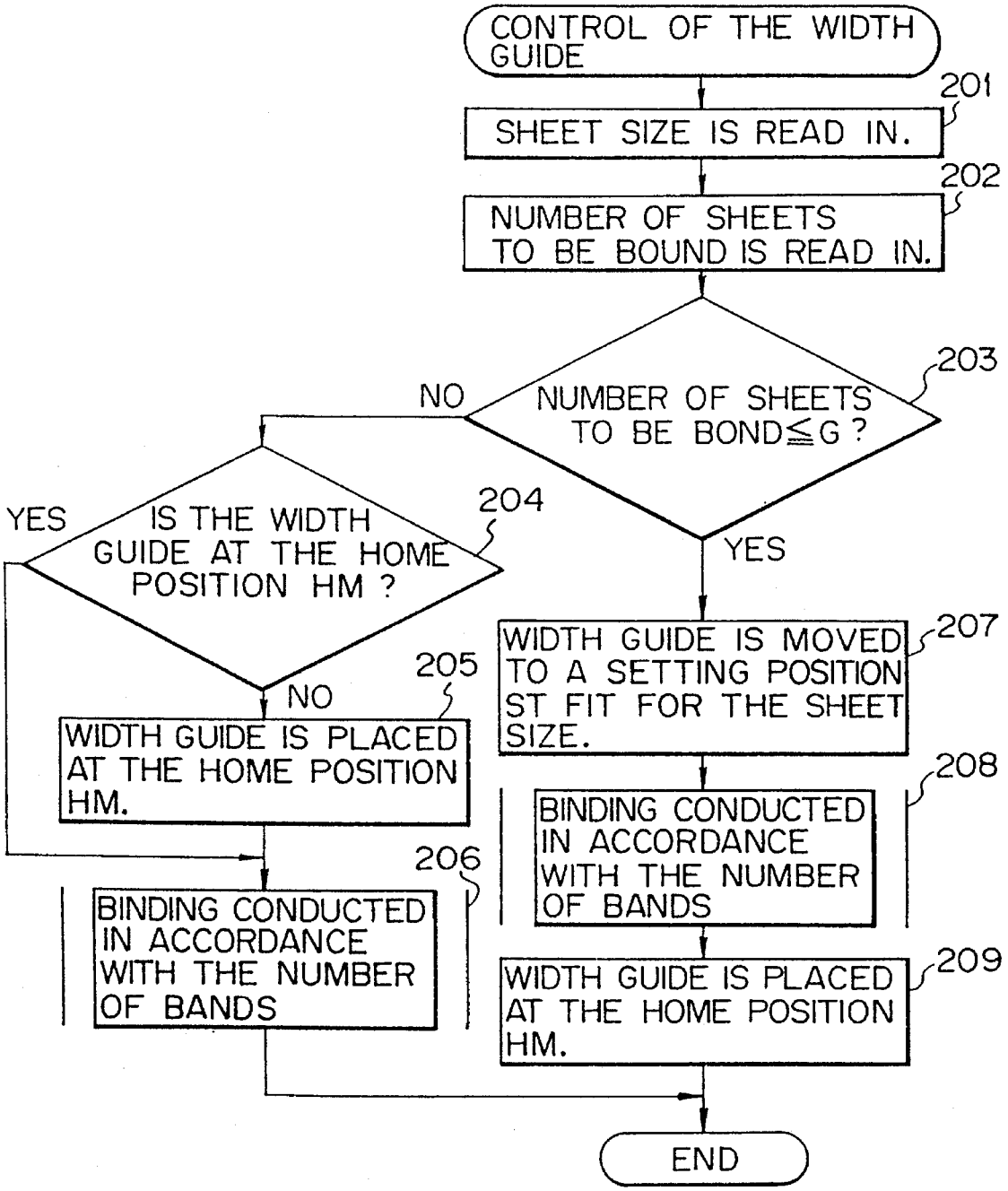
FIG. 20 is a flowchart showing the procedure to control the operation of the sheet width guide of the binding apparatus shown in FIG. 19A.

With reference to FIGS. 19A, 19B, 21A and 21B, a binding operation of this fourth example will be explained in accordance with the flowchart shown in FIG. 20.

In step 201, the sheet size is read in, and in the subsequent step 202, the number of sheets of cut paper S to be bound is read in. In step 203, it is judged whether or not the read number of sheets to be bound is not more than a predetermined number G. In the case where the number of sheets to be bound is larger than G, the thickness of the bundle of the sheets of cut paper S is large, so that there is no possibility that the bundle of the sheets are bent. Accordingly, the program advances to step 204. In step 204, it is judged whether or not the sheet width guides 301, 302 are placed at the home positions HM. In the case where the sheet width guides 301, 302 are placed at the home positions HM, the program advances to step 206, and in the case where the sheet width guides 301, 302 are not placed at the home positions HM, the sheet width guides 301, 302 are made to be placed at the home positions HM in step 205, and then the program advances to step 206. In step 206, a binding operation is carried out in accordance with the number of bands.

On the other hand, in the case where the read number of sheets to be bound is not more than the predetermined number of sheets G in step 203, the thickness of the bundle of sheets of cut paper S is small. Therefore, there is a possibility that the bundle of sheets are bent by a force applied to the band. Accordingly, the program advances to step 207, and the sheet width guides 301, 302 are moved to the setting positions ST in accordance with the sheet size that was read in step 201.

After that, in step 208, the bundle of sheets are bound together with the sheet width guides 301, 302 by the tying machine 30 with the bands, the number of which corresponds to the aforementioned one. Since the sheet width guides 301, 302 are made of a rigid plate, they are not bent even in the binding process.

After the binding operation has been completed in the aforementioned manner, the program advances to step 209, and the sheet width guides 301, 302 are moved to the home positions HM. After the sheet width guides 301, 302 have been moved to the home positions HM as shown in FIG. 19B, the conveyance arm 10 conveys the bundle of sheets of cut paper S as shown in FIG. 21B.

Due to the foregoing, the bundle of sheets of cut paper S are released from the guide plates 301, 302, and moved to the output unit 40 side while the bundle of sheets are bound with the band.

As explained above, the sheet width guides 301, 302, which are auxiliary plates, are provided in the fourth example, so that even a small number of sheets of cut paper can be bound without causing deflection. The setting positions ST of the sheet width guides 301, 302 can be varied in accordance with the sheet size. Therefore, the sheet width guides 301, 302 can be applied to the sheets of different sizes, and further when the bundle of sheets are conveyed after they have been bound, the sheet width guides 301, 302 cannot obstruct the conveyance motion.

Figure 22:
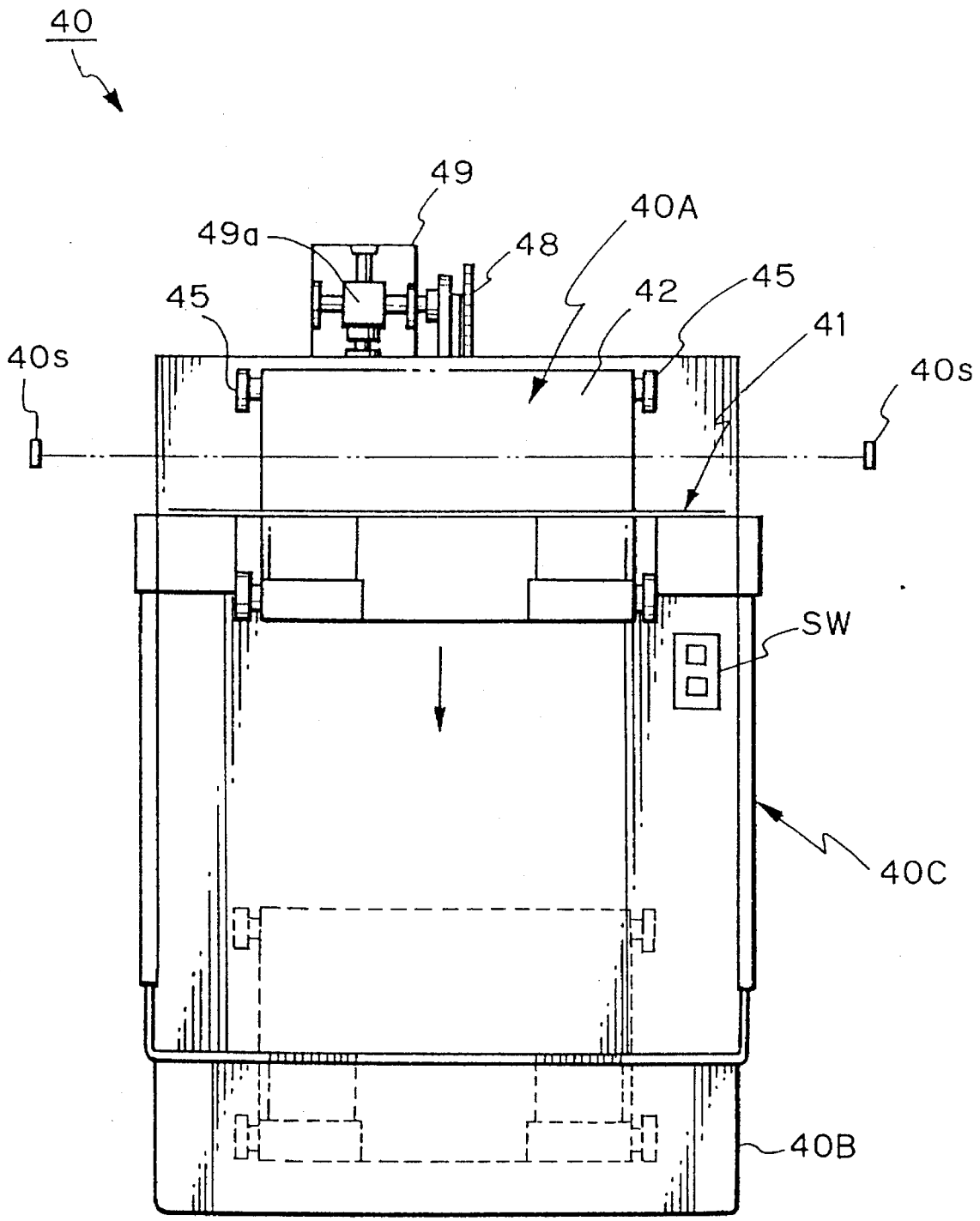
FIG. 22 is a schematic illustration showing the structure of the fifth example in which the output table of the binding apparatus of the present invention can be arbitrarily lowered.

FIG. 22 is a view showing the fifth example of the present invention. In the fifth example, height of the elevation table 41 of the output unit 40 is detected by the sensor 40*s* and the elevation table is elevated so that the bundles of sheets of cut paper S can be smoothly stacked in the order of binding operations.

Concerning the members shown in FIG. 22, like members in FIGS. 12 and 13 are identified by the same reference characters. Consequently, numeral 40A is an elevation unit, numeral 40B is a base unit, numeral 41 is an elevation table, numeral 42 is an elevation frame, numeral 45 is a wheel, numeral 48 is a chain, and numeral 49 is a reduction mechanism. The reduction mechanism 49 is provided with a worm mechanism 49*a*. Numeral 40C is a container, which is elevated together with the elevation frame 42. Further in this example, a table-down switch SW is mounted on the door of a container 40C. When this switch SW is pressed, the container 40C can be lowered at any time.

In this fifth example, when a bundle of bound sheets of cut paper S are conveyed by the conveyance arm 10 and placed on the elevation table 41, the uppermost surface of this bundle of sheets is detected by the height sensor 40*s*, and the elevation table 41 is lowered to a predetermined position in accordance with this detection signal. This operation is repeatedly conducted each time a bundle of sheets of cut paper S are stacked. When a predetermined number of bundles of sheets are stacked, the condition is detected by a stackfull sensor not shown in the drawings. When the table-down switch mounted on the door of the container is operated so as to lower the container, the stacked bundles of sheets can be taken out from the container at any time.

Figure 23:
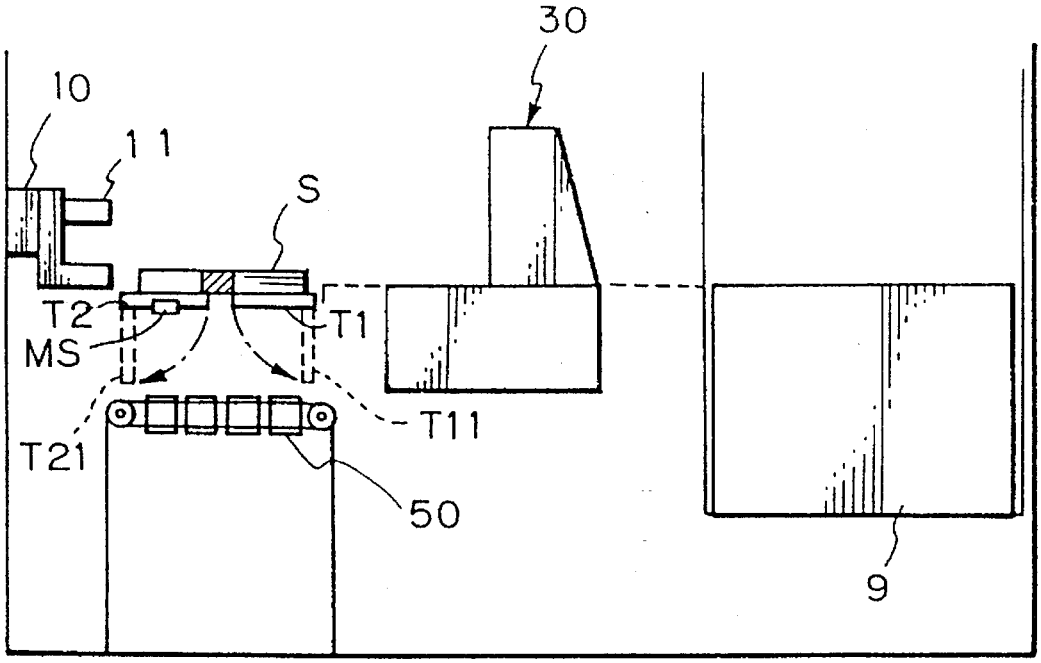
FIG. 23 is a schematic illustration showing the structure of the sixth example in which a conveyance device is provided to the output table in the binding apparatus of the present invention.

FIG. 23 is a view showing the sixth example of the present invention. In the sixth example, there is provided an automatic conveyance device that can automatically convey the bundles of bound sheets of cut paper S to another place or another device, for example, a packing or pasting process.

The bundles of sheets of cut paper S that have been bound by the tying machine 30 are conveyed onto the tables T1 and T2 by the conveyance arm 10. A pair of tables T1 and T2 compose one table, and these tables T1 and T2 are opposed to each other, wherein a predetermined gap is formed between the tables. The tables T1 and T2 are formed into a double door, and can be opened to the positions T11 and T21 illustrated by dotted lines in the drawing. Consideration is given so that the drop height cannot be increased when the tables T1 and T2 are opened as illustrated by dotted lines in FIG. 23.

When a bundle of sheets of cut paper S are placed on these tables T1 and T2, the microsensor MS is turned on, and then a drive unit not shown in the drawings is activated, so that the tables T1 and T2 are opened to the positions T11 and T21 illustrated by dotted lines.

Then, the bundle of sheets of cut paper S are moved onto a conveyor 50 disposed right below the tables T1 and T2. After a predetermined period of time has passed from the output of the ON-signal of the microsensor MS, the conveyor 50 is driven, and the bundle of sheets of cut paper S are automatically conveyed to another place.

Figure 24:
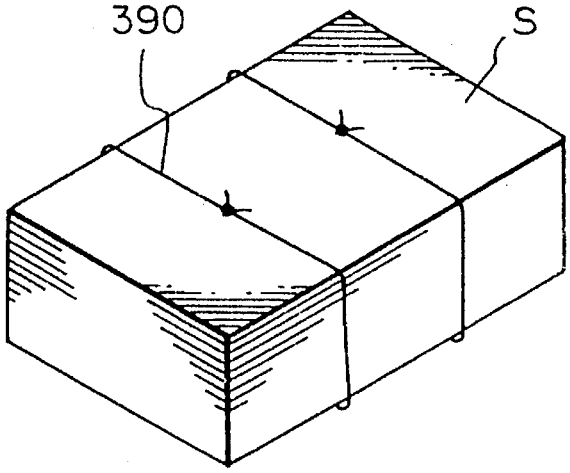
FIG. 24 is a perspective view showing a bundle of cut sheets bound with a string-shaped binding medium.

In the examples described above, the bundle of sheets are bound with a band-shaped member (a band), however, it should be understood that the present invention is not limited to a specific example. The bundle of sheets may be bound with a string-shaped binding medium 390 shown in FIG. 24.

We claim:

1. A binding apparatus to bind sheets of printed cut paper discharged to a stack unit provided in a continuous printing system including a sheet hopper from which sheets of cut paper are supplied one by one, a printing unit that prints on the supplied sheets of cut paper, and the stack unit on which the sheets of printed cut paper are stacked, said binding apparatus comprising:

conveyance means provided adjacent to said stack unit, including gripper means for holding an end portion of a bundle of sheets of printed cut paper on the stack unit in a vertical direction with respect to a planar surface of the stacked sheets of paper and moving means for moving said gripper means along a straight line in parallel with the planar surface of the stacked sheets of cut paper;

binding means provided at a first location in a moving passage of said conveyance means, for winding the conveyed bundle of sheets of cut paper with an elongated binding medium;

an output unit provided at a second location more remote from said stack unit than the first location, in the moving passage of said conveyance means, which stocks the bundles of sheets of cut paper wound by said binding means; and a control unit that controls operations of said conveyance means and said binding means.

2. The binding apparatus according to claim 1, wherein a recessed portion is provided on an end surface of a table of said stack unit on which said sheets of cut paper are stacked, so that said conveyance means can hold an end portion of said bundle of sheets of cut paper in a vertical direction.

3. The binding apparatus according to claim 2, wherein said conveyance means includes: a hand unit that holds said bundle of sheets of cut paper; a traveling unit provided adjacent to said hand unit; and a traveling guide unit on which said traveling unit travels, and said hand unit holds said bundle of sheets of cut paper in said recessed portion formed in said stack unit.

4. The binding apparatus according to claim 3, wherein said traveling guide of said conveyance means includes U-shaped rails opposed to each other, and said traveling unit includes longitudinal and lateral guide wheels to regulate the attitude of said traveling unit inside said rails, and further includes traveling wheels that travel on a rail provided on a ceiling surface of said traveling guide unit.

5. The binding apparatus according to claim 1, wherein said table of said stack unit on which said bundle of sheets of cut paper are stacked, is elevated by a drive chain.

6. The binding apparatus according to claim 1, wherein said binding means includes a roll-shaped band, and said bundle of sheets of cut paper are bound with said band when the bundle of sheets of cut paper are encircled by said band and then said band is cut.

7. The binding apparatus according to claim 6, wherein said binding means includes two width guides, the interval of which can be changed in accordance with the width of sheets to be bundled, and when the number of sheets to be bundled is small, the maximum width of said width guides is set to be the same as the width of the sheets and then the sheets are bundled, and the width of said guides is reduced after the binding operation has been completed.

8. The binding apparatus according to claim 1, wherein said binding means includes a roll-shaped string, and binding is carried out when said string is wound around a bundle of sheets of paper.

9. The binding apparatus according to claim 1, wherein said output unit includes an elevation table to stock a bundle of sheets of cut paper that have been bound.

10. The binding apparatus according to claim 9, wherein said elevation table is driven by a chain.

11. The binding apparatus according to claim 1, wherein said output unit includes conveyance means to move a bundle of sheets of cut p paper that have been bound away from said output unit.

12. The binding apparatus according to claim 1, wherein said control unit controls the binding operations conducted by said conveyance and binding means for each job.

13. The binding apparatus according to claim 1, wherein said control unit controls the number of said binding mediums to be one or plural in accordance with the thickness of sheets of cut paper to be bound.

14. The binding apparatus according to claim 13, wherein said control unit is connected with an input means to input the number of binding mediums from the outside.

15. The binding apparatus according to claim 1, wherein said control unit is connected with a setting means to set positions of said binding mediums from the outside.

16. A printing system comprising:

a printing unit that prints on supplied sheets of cut paper;

a stack unit on which the sheets of printed cut paper are stacked; and a binding unit which binds the sheets of printed cut paper, including:

conveyance means, provided adjacent to said stack unit, including gripper means for holding an end portion of a bundle of sheets of printed cut paper on the stack unit in a vertical direction with respect to a planar surface of the Stacked sheets of cut paper, and moving means for moving said gripper means along a straight line in parallel with the planar surface of the stacked sheets of cut paper;

binding means, provided at a first location in a moving passage of said conveyance means, for winding the conveyed bundle of sheets of cut paper with an elongated binding medium;

an output unit, provided at a second location more remote from said stack unit than the first location, in the moving passage of said conveyance means, which stocks the bundles of sheets of cut paper wound by said binding means; and a control unit that controls the operations of said conveyance means, and said binding means.

17. The printing system according to claim 16, wherein a recessed portion is formed on an end surface of said table of said stack unit on which the sheets of cut paper are stacked, so that the end portion of said sheets of cut paper can be held by said conveyance means in a vertical direction.

18. The printing system according to claim 17, wherein said conveyance means includes a hand unit to hold said bundle of sheets of cut paper, a traveling unit provided adjacent to said hand unit, and a traveling guide unit on which said traveling unit travels, and said hand unit holds said bundle of sheets in said recessed portion of the stack unit in a vertical direction.

19. The printing system according to claim 18, wherein said traveling guide of said conveyance means includes U-shaped rails opposed to each other, and said traveling unit includes longitudinal and lateral guide wheels to regulate the attitude of said traveling unit inside the rails, and traveling wheels that travel on a rail provided on a ceiling surface of said traveling guide unit.

20. The printing system according to claim 16, wherein a table of said stack unit on which the sheets of cut paper are stacked is elevated by a chain.

21. The printing system according to claim 16, wherein said binding means includes a roll-shaped band, and said bundle of sheets of cut paper are bound with said band when the bundle of sheets of cut paper are encircled by said band and then said band is cut.

22. The printing system according to claim 21, wherein said binding means includes two width guides, the interval of which can be changed in accordance with the width of sheets to be bundled, and when the number of sheets to be bundled is small, the maximum width of said width guides is set to be the same as the width of the sheets and then the sheets are bundled, and the width of said guides is reduced after the binding operation has been completed.

23. The printing system according to claim 16, wherein said binding means includes a roll-shaped string, and binding is carried out when this string is wound around a bundle of sheets of paper.

24. The printing system according to claim 16, wherein said output unit includes an elevation table to stock a bundle of sheets of cut paper that have been bound.

25. The printing system according to claim 24, wherein said elevation table is driven by a chain.

26. The printing system according to claim 16, wherein said output unit includes conveyance means to move a bundle of sheets of cut paper that have been bound away from said output unit.

27. The printing system according to claim 16, wherein said control unit controls the binding operations conducted by said conveyance and binding means for each job.

28. The printing system according to claim 16, wherein said control unit controls the number of said binding mediums to be one or plural in accordance with the thickness of sheets of cut paper to be bound.

29. The printing system according to claim 28, wherein said control unit is connected with an input means to input the number of binding mediums from the outside.

30. The printing system according to claim 16, wherein said control unit is connected with a setting means to set positions of said binding mediums from the outside.

31. A binding apparatus to bind sheets of printed paper discharged to a stack unit provided in a continuous printing system including a sheet hopper from which sheets of cut paper are supplied one by one, a printing unit that prints on the supplied sheets of cut paper, a number of sheets to be printed by the printing unit being varied dependent upon printing jobs, and the stack unit on which the sheets of printed cut paper are stacked, said binding apparatus comprising:

conveyance means, provided adjacent to said stack unit, including gripper means for holding an end portion of a bundle of sheets of printed cut paper on the stack unit in a vertical direction with respect to a planar surface of the stacked sheets of paper, and moving means for moving said gripper means along a straight line in parallel with the planar surface of the stacked sheets of cut paper;

binding means, provided at a first location in a moving passage of said conveyance means, for winding the conveyed bundle of sheets of cut paper with an elongated binding medium;

an output unit, provided at a second location more remote from said stack unit than the first location, in the moving passage of said conveyance means, which stocks the bundles of sheets of cut paper wound by said binding means; and a control unit that controls the operations of said conveyance means and said binding means, said control unit counting a number of sheets which have been stacked on the stack unit, and causing said binding means to vary a quantity of the elongated binding medium winding the conveyed bundle of sheets of cut paper in accordance with the counted number.

32. A printing system comprising:

a printing unit that prints on supplied sheets of cut paper, a number of sheets to be printed being variable dependent upon printing jobs;

a stack unit on which the sheets of printed cut paper are stacked; and a binding unit which binds the sheets of printed cut paper, including:

conveyance means, provided adjacent to said stack unit, including gripper means for holding an end portion of a bundle of sheets of printed cut paper on the stack unit in a vertical direction with respect to a planar surface of the stacked sheets of cut paper, and moving means for moving said gripper means along a straight line in parallel with the planar surface of the stacked sheets of cut paper;

binding means, provided at a first location in a moving passage of said conveyance means, for winding the conveyed bundle of sheets of cut paper with an elongated binding medium;

an output, provided at a second location more remote from said stack unit than the first location, in the moving passage of said conveyance means, which stocks the bundles of sheets of cut paper wound by said binding means; and a control unit that controls operations of said conveyance means and said binding means, said control unit counting a number of sheets which have been stacked on the stack unit, and causing said binding means to vary a quantity of the elongated binding medium winding the conveyed bundle of sheets of cut paper in accordance with the counted number.

* * * * *